US007426919B2

(12) United States Patent
Kano et al.

(10) Patent No.: US 7,426,919 B2
(45) Date of Patent: Sep. 23, 2008

(54) EVAPORATIVE FUEL TREATMENT APPARATUS

(75) Inventors: Masao Kano, Gamagori (JP); Shinsuke Takakura, Kariya (JP); Noriyasu Amano, Gamagori (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/603,901

(22) Filed: Nov. 24, 2006

(65) Prior Publication Data

US 2007/0119423 A1 May 31, 2007

(30) Foreign Application Priority Data

Nov. 30, 2005 (JP) ..... 2005-346475

(51) Int. Cl.
*F02M 33/02* (2006.01)

(52) U.S. Cl. ..... 123/520; 123/198 D

(58) Field of Classification Search ..... 123/520, 123/516, 519, 518, 198 DB, 198 D
See application file for complete search history.

(56) References Cited

U.S. PATENT DOCUMENTS 5,390,645 A * 2/1995 Cook et al. ..... 123/520
6,431,156 B1 * 8/2002 Murakami et al. ..... 123/520
6,722,348 B2 * 4/2004 Nagasaki et al. ..... 123/520
6,971,375 B2 12/2005 Amano et al.
7,069,916 B2 7/2006 Osanai
2001/0049958 A1 * 12/2001 Yamaguchi et al. ..... 73/40.5 R
2002/0157653 A1 * 10/2002 Streib ..... 123/520
2003/0213478 A1 * 11/2003 Fritz et al. ..... 123/520
2005/0011185 A1 * 1/2005 Annoura et al. ..... 60/289
2005/0011499 A1 * 1/2005 Hara et al. ..... 123/520
2005/0044938 A1 * 3/2005 Tsuruta et al. ..... 73/118.1
2006/0031000 A1 2/2006 Amano et al.
2006/0042605 A1 3/2006 Amano et al.
2006/0130817 A1 * 6/2006 Gonze et al. ..... 123/520

OTHER PUBLICATIONS

U.S. Appl. No. 11/398,755, filed Apr. 2006, Kano et al., (Corresponds to JP-2005-291437).

* cited by examiner

*Primary Examiner*—Carl S Miller
(74) *Attorney, Agent, or Firm*—Nixon & Vanderhye, PC

(57) ABSTRACT

An evaporative fuel treatment apparatus is disclosed that includes a fuel tank and a purge passage that fluidly couples the intake path of an internal combustion engine and the fuel tank. The apparatus also includes a purge valve that is installed in the purge passage and controls the quantity of evaporative fuel purged from the fuel tank into the intake path. Furthermore, the apparatus includes an evaporative fuel status measuring device that measures a density-based status of evaporative fuel in the fuel tank. Additionally, the apparatus includes a purge valve controlling device that controls the purge valve based on the density-based status of the evaporative fuel measured by the evaporative fuel status measuring device.

8 Claims, 22 Drawing Sheets

FIG. 8
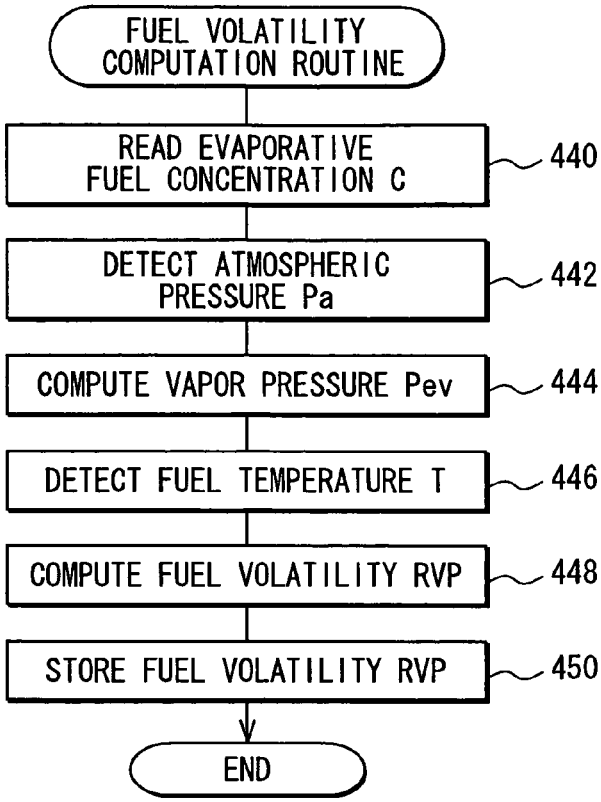
FIG. 9A
| FUEL | A | B | C | D | E | F |
|---|---|---|---|---|---|---|
| RVP (kPa) | 35 | 48 | 55 | 62 | 70 | 90 |
FIG. 9B
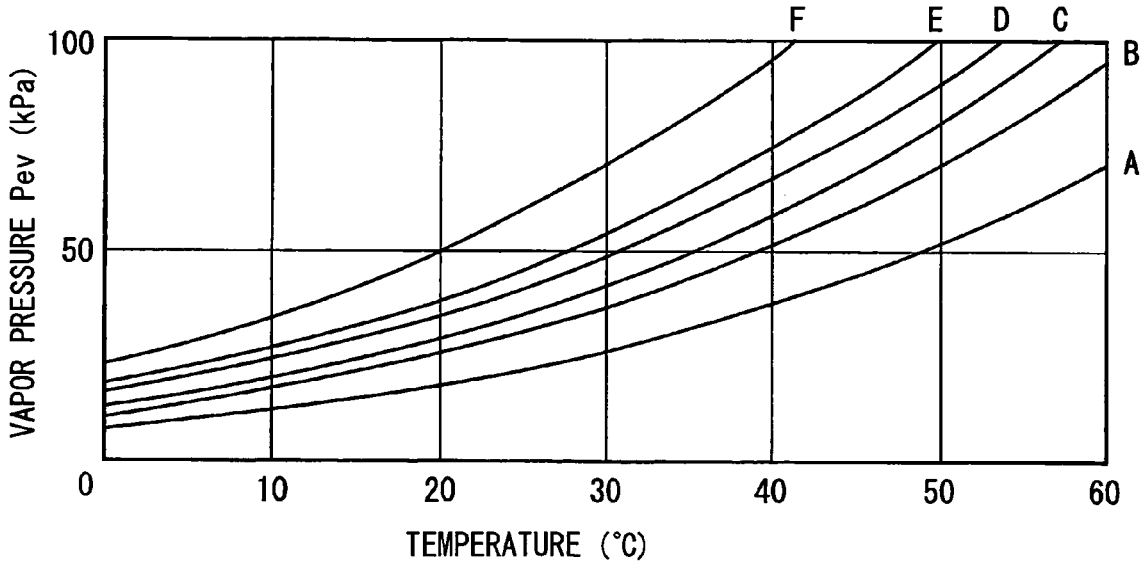

EVAPORATIVE FUEL TREATMENT APPARATUS

CROSS REFERENCE TO RELATED APPLICATION

The following is based on and claims priority to Japanese Patent Application No. 2005-346475, filed Nov. 30, 2005, which is hereby incorporated by reference in its entirety.

FIELD

The following relates to an evaporative fuel treatment apparatus that purges evaporative fuel in a fuel tank to an intake path.

BACKGROUND

Evaporative fuel treatment apparatuses are known in which the intake path of an internal combustion engine and a fuel tank are coupled through a purge passage. Evaporative fuel produced in the fuel tank is purged into the intake path. For example, U.S. Pat. No. 7,069,916 (i.e., JP-2005-90281A) discloses such a system.

The evaporative fuel in the fuel tank can be saturated, and the quantity of evaporative fuel produced in a fuel tank is large. Also, a concentration of purged evaporative fuel fluctuates less as compared with cases where the evaporative fuel in a fuel tank is absorbed into a canister and then purged from the canister into the intake path. The evaporative fuel is higher in combustion efficiency than fuel spray injected from a fuel injection valve. Therefore, an internal combustion engine can be more readily started by purging evaporative fuel during engine start from the fuel tank into the intake path.

In the technology disclosed in U.S. Pat. No. 7,069,916, a quantity of evaporative fuel purged from the fuel tank into the intake path is controlled by measuring the pressure and temperature of the interior of the fuel tank. A concentration of the evaporative fuel in the fuel tank is set according to these measured values.

However, this method has certain disadvantages. Specifically, vapor pressure differs according to the fuel property, i.e., the types of components and/or the ratio of fuel components in the fuel. Therefore, when fuel properties differ, the concentration of evaporative fuel in the fuel tank differs as well even though the pressure and temperature of the interior of the fuel tank are the same. Thus, when an evaporative fuel concentration is set according to the pressure and temperature of the interior of the fuel tank, the set evaporative fuel concentration and the actual evaporative fuel concentration can be different from each other depending on fuel property. As a result, a quantity of evaporative fuel purged into the intake path may be inaccurately controlled.

SUMMARY

An evaporative fuel treatment apparatus is disclosed that includes a fuel tank and a purge passage that fluidly couples the intake path of an internal combustion engine and the fuel tank. The apparatus also includes a purge valve that is installed in the purge passage and controls the quantity of evaporative fuel purged from the fuel tank into the intake path. Furthermore, the apparatus includes an evaporative fuel status measuring device that measures a density-based status of evaporative fuel in the fuel tank. Additionally, the apparatus includes a purge valve controlling device that controls the purge valve based on the density-based status of the evaporative fuel measured by the evaporative fuel status measuring device.

BRIEF DESCRIPTION OF THE DRAWINGS

FIG. 8 is a flowchart illustrating a fuel volatility computation routine for the evaporative fuel treatment apparatus of FIG. 1;

FIG. 9A is a chart illustrating a relationship between fuel property and fuel volatility RVP, and FIG. 9B is a characteristic graph illustrating a relationship between temperature and vapor pressure;

DETAILED DESCRIPTION OF THE PREFERRED EMBODIMENTS

Figure 1:
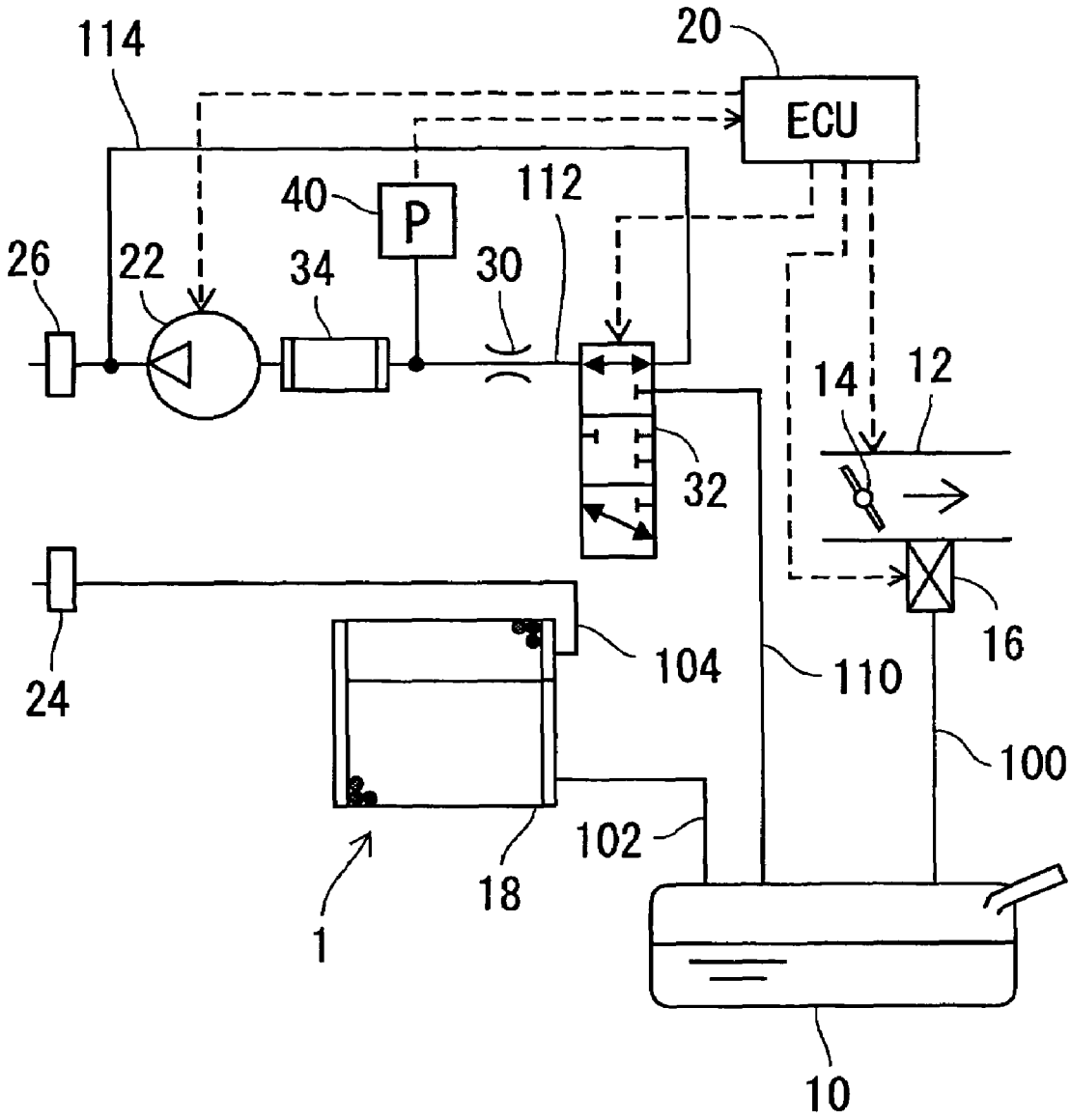
FIG. 1 is a schematic diagram illustrating one embodiment of an evaporative fuel treatment apparatus.

Hereafter, description will be given to multiple embodiments of the invention with reference to the drawings. Referring initially to FIG. 1, an evaporative fuel treatment apparatus is shown. As will be discussed, the apparatus measures a density-based status of evaporative fuel in the fuel tank. For instance, in one embodiment, the apparatus measures the concentration of evaporative fuel in an air-fuel mixture, and the opening of a purge valve 16 and the quantity of fuel injected from a fuel injection valve (not shown) are controlled according to the measured evaporative fuel concentration.

The apparatus includes a fuel tank 10 and an intake path 12 that are fluidly coupled through a purge passage 100. A purge valve 16 is a valve whose opening is controlled and adjusted according to a duty ratio. The purge valve 16 controls the flow rate of fluid flowing in the purge passage 100 according to the duty ratio. In another embodiment, the purge valve 16 is an electromagnetic valve that is linearly controlled.

A first canister 18 communicates with the fuel tank 10 through a passage 102. As such, the evaporative fuel produced in the fuel tank 10 flows through the passage 102 and is absorbed into absorbent, such as activated carbon, in the first canister 18. The first canister 18 is open to the air via a passage 104 through a filter 24. When the purge valve 16 is opened, the evaporative fuel absorbed in the first canister 18 is desorbed by the negative pressure in the intake path 12 and flows into the fuel tank 10. As a result, the evaporative fuel in the fuel tank 10 flows through the purge passage 100 and is purged into the intake path 12.

A control device (ECU) 20 is also included that is constructed of a CPU, ROM, EEPROM, RAM, and the like (not shown). The ECU 20 executes stored control programs and operates a throttling device 14, the purge valve 16, a pump 22, an electromagnetic valve 32, the fuel injection valve, and the like. In this embodiment, the ECU 20 constitutes each of a purge valve controlling device, a concentration measuring device, concentration computing device, and fuel property measuring device as will be discussed in greater detail below.

Furthermore, a throttle 30 is included that is provided in a measuring passage 112. In the measuring passage 112 on one side of the throttle 30, the electromagnetic valve 32 is provided between the throttle 30 and the fuel tank 10. In the measuring passage 112, on the side of the throttle 30 opposite the electromagnetic valve 32, a second canister 34, the pump 22, and a filter 26 are provided. The pump 22 is provided between the second canister 34 and the filter 26, and the second canister 34 is provided adjacent the throttle 30. A passage 114 fluidly couples the electromagnetic valve 32 and a portion of the measuring passage 112 between filter 26 and the discharge side of the pump 22.

The electromagnetic valve 32 is a selector valve. In one embodiment, the electromagnetic valve 32 is a three-way electromagnetic valve. The electromagnetic valve 32 switches between communication of the throttle 30 and the passage 110 on the fuel tank 10 side, communication of the throttle 30 and the passage 114 on the atmospheric air side, and interruption between the throttle 30 and the passage 110 and the passage 114. In this embodiment, when there is no current, the state of the electromagnetic valve 32 is one in which the throttle 30 and the passage 114 are fluidly coupled.

The second canister 34 is provided in the measuring passage 112 between the throttle 30 and the pump 22. The second canister 34 houses absorbent, such as activated carbon, similar to the first canister 18. Therefore, when the pump 22 is operated to reduce pressure in the measuring passage 112 when the switching state of the electromagnetic valve 32 allows communication between the throttle 30 and the passage 110, the evaporative fuel in the fuel tank 10 is sucked into the measuring passage 112. Also, when the air-fuel mixture of air and evaporative fuel passes through the throttle 30 and then through the second canister 34, the second canister 34 absorbs and removes the evaporative fuel from the air-fuel mixture. Therefore, even after the air-fuel mixture passes through the throttle 30, what is detected by the pressure sensor 40 is the pressure of air that passes through the pump 22.

As mentioned above, the second canister 34 is placed between the pump 22 and the throttle 30, and evaporative fuel is removed from air-fuel mixture that passed through the throttle 30. Thus, as compared with cases where the second canister 34 is not installed, there is a greater difference between an air pressure $\Delta P_{AIR}$ detected by the pressure sensor 40 when only air passes through the throttle 30 and an air-fuel mixture pressure $\Delta P_{GAS}$ detected by the pressure sensor 40 when the air-fuel mixture of air and evaporative fuel passes through the throttle 30. Therefore, a sufficiently large gain G can be ensured for the pressure resolution of the pressure sensor 40. The concentration of evaporative fuel in the air-fuel mixture can be obtained taking $\Delta P_{GAS}/\Delta P_{AIR}$ as one parameter. Therefore, when the difference between air pressure $\Delta P_{AIR}$ and air-fuel mixture pressure $\Delta P_{GAS}$ is increased, the accuracy of detection of air-fuel mixture pressure $\Delta P_{GAS}$ relative to air pressure $\Delta P_{AIR}$ is improved. Furthermore the accuracy of computation of evaporative fuel concentration is improved.

The pressure sensor 40 is operatively connected to the measuring passage 112 between the throttle 30 and the second canister 34, and detects the pressure in the measuring passage 112 between the pump 22 and the throttle 30. Since the back pressure side of the pressure sensor 40 is open to the air, the pressure detected by the pressure sensor 40 is equivalent to the differential pressure between the pressure in the measuring passage 112 between the pump 22 and the throttle 30 and the atmospheric pressure. When the electromagnetic valve 32 connects the throttle 30 and either of the passages 110, 114, the pressure in the corresponding passage 110, 114 is substantially equivalent to the atmospheric pressure. Therefore, the pressure detected by the pressure sensor 40 is substantially equivalent to the differential pressure across the throttle 30. It will be appreciated that the differential pressure across the throttle 30 may be directly detected with a differential pressure sensor in place of the pressure sensor 40.

Operation of Evaporative Fuel Treatment Apparatus

Each routine described below is carried out by a control program stored in the ECU 20.

Main Routine #1

Figure 2:
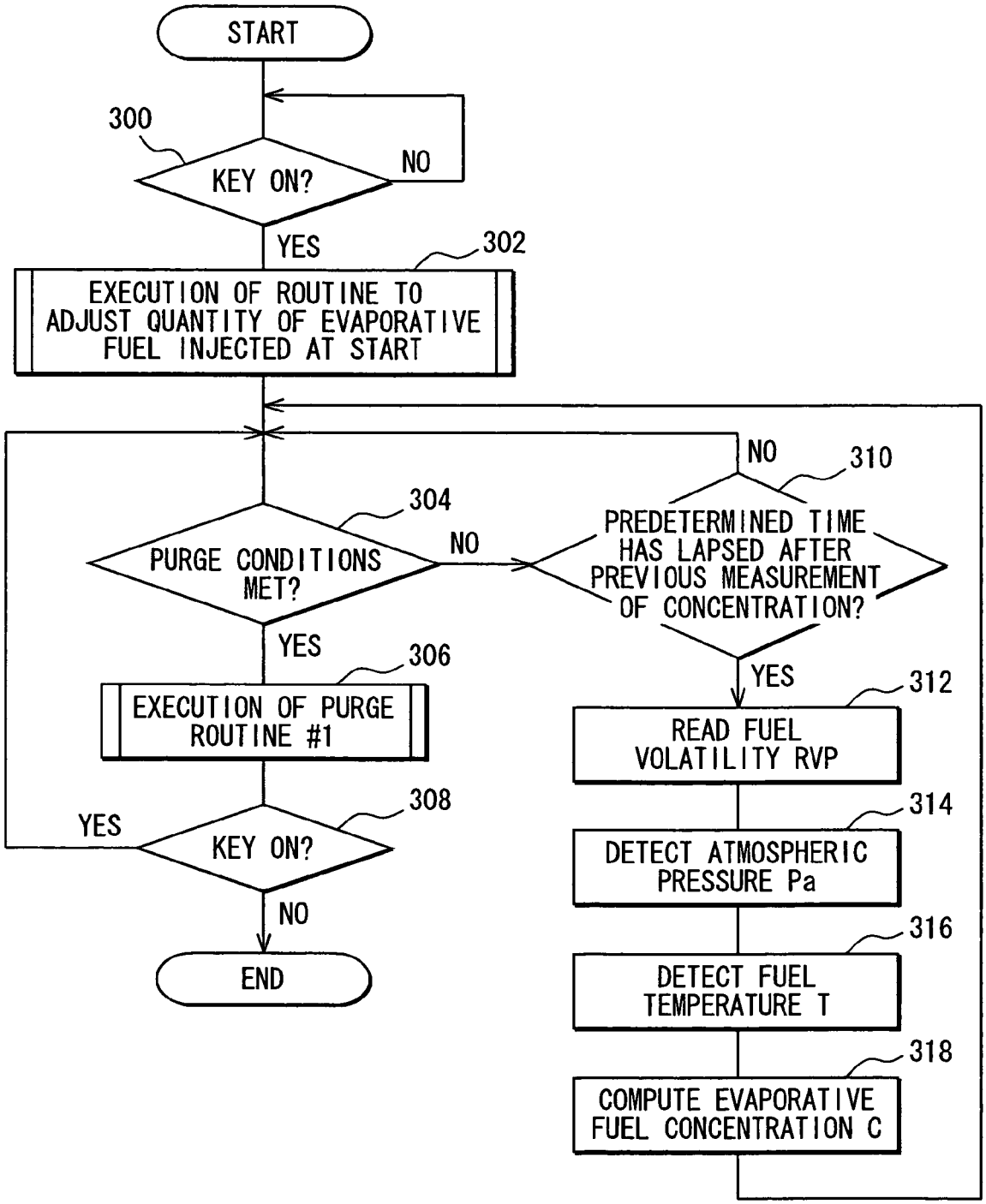
FIG. 2 is a flowchart illustrating one embodiment of a main routine for the evaporative fuel treatment apparatus of FIG. 1.

The routine illustrated in FIG. 2 is main routine #1 for controlling a quantity of evaporative fuel purged from the fuel tank 10 into the intake path 12 based on the concentration of evaporative fuel in the fuel tank 10.

Beginning at Step S300, the ECU 20 determines whether or not an ignition key has been turned on. When the ignition key has been turned on, the ECU 20 carries out a routine at Step S302. This routine is for adjusting a purge quantity of evaporative fuel purged from the fuel tank 10 into the intake path 12 at an engine starting time.

After the ECU 20 adjusts a purge quantity at Step S302 when the engine starting time commences, the ECU 20 determines at Step S304 whether or not purge execution conditions have been met. When the purge execution conditions have been met, the ECU 20 carries out purge routine #1 at Step S306. Purge routine #1 is a routine to purge evaporative fuel from the fuel tank 10 into the intake path 12 based on the concentration of evaporative fuel in the fuel tank 10.

When the purge execution conditions have not been met (i.e., Step S304 answered negatively), Step S310 follows and the ECU 20 determines whether or not a predetermined time has lapsed after the measurement of the concentration of evaporative fuel in the fuel tank 10. If Step S310 is answered negatively, Step S304 follows. However, if the predetermined time has lapsed after the concentration of evaporative fuel was measured, there is the possibility that the quantity of evaporative fuel in the fuel tank 10 has varied and the concentration of evaporative fuel has been changed. Further, there is the possibility that the ambient environment, such as temperature, of the evaporative fuel treatment apparatus 1 has changed and the air pressure $\Delta P_{AIR}$ and the shutoff pressure Pt to be described has changed. Thus, when the predetermined time has lapsed after the concentration of evaporative fuel in the fuel tank 10 was measured (i.e., Step S310 is answered affirmatively), Steps S312, S314, S316, and S318 follow. More specifically, in Step S312, fuel volatility RVP (Reid Vapor Pressure) is determined. Then in Step S314, the atmospheric pressure Pa determined. Next, in Step S316, the fuel temperature T is determined. Subsequently, in Step S318 as will be described in greater detail below, a concentration C of evaporative fuel in the fuel tank 10 is computed based on the property of the fuel in the fuel tank 10 determined and the results of Steps S312 through S316. Once C is computed in Step S318, the ECU 20 proceeds to Step S304.

Fuel Property Measurement Routine

Before the execution of the routine to adjust the quantity of evaporative fuel injected at start in main routine #1 illustrated in FIG. 2, the ECU 20 carries out at least one of the routines illustrated in FIGS. 3, 4, 5, and 6. The ECU 20 thereby measures the property of fuel in the fuel tank 10.

Figure 3:
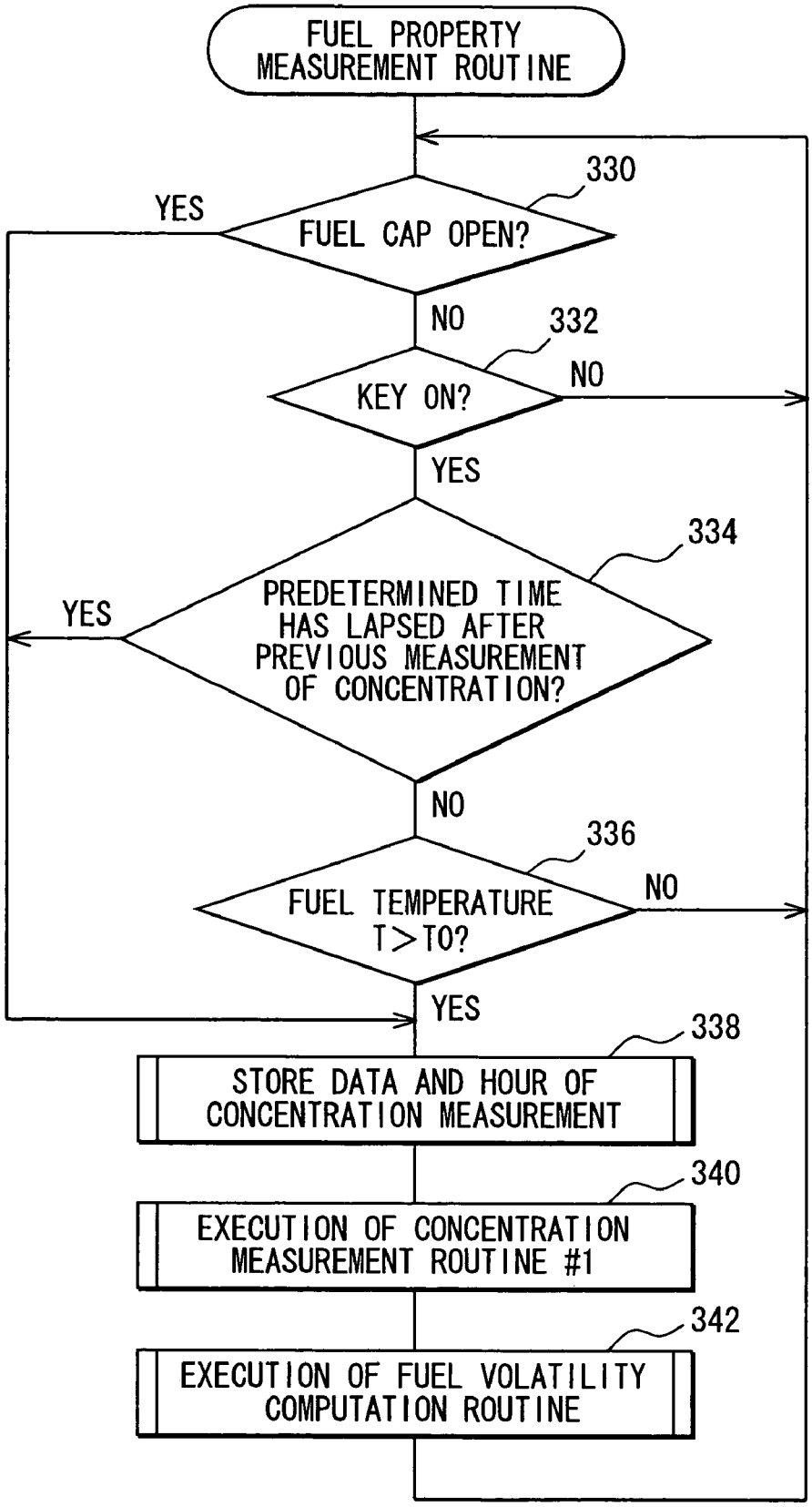
FIG. 3 is a flowchart illustrating one embodiment of a fuel property measurement routine for the evaporative fuel treatment apparatus of FIG. 1.

At Step S330 in FIG. 3, the ECU 20 determines whether or not the fuel cap is open. When the fuel cap is open, the ECU 20 determines that fuel is being fed into the fuel tank 10. When fuel is fed into the fuel tank 10, the ECU 20 determines that there is the possibility that fuel being fed is different in property from the fuel already in the fuel tank 10. Thus, processing of Steps S338, S340, and then S342 is carried out to store the date and hour of measurement and measure fuel property.

In cases where the fuel cap is not open (i.e., Step S330 is answered negatively) step S332 follows, and it is determined whether the ignition key is on. If the ignition key is off (i.e., Step S332 is answered negatively), the ECU 20 returns to the processing of Step S330.

In cases where the ignition key has been turned on (i.e., Step S332 is answered affirmatively), the ECU 20 determines at Step S334 whether or not a predetermined time has lapsed after the previous concentration measurement. In cases where the predetermined time has lapsed after the previous concentration measurement (i.e., Step S334 answered affirmatively), the ECU 20 determines that there is the possibility that the property of fuel in the fuel tank 10 has been changed with time since the previous concentration measurement. Then, the ECU 20 carries out the processing of Step S338, 340, and then 342 to store the data and hour of measurement and measure the fuel property.

In cases where the predetermined time has not lapsed after the previous concentration measurement (i.e., Step S334 answered negatively), the ECU 20 determines at Step S336 whether or not the fuel temperature T is greater than a predetermined temperature T0. In cases where the fuel temperature T is not greater than the predetermined temperature T0, the ECU 20 returns to the processing of Step S330. In cases where the fuel temperature T is greater than the predetermined temperature T0, the ECU 20 determines that there is the possibility that a large quantity of highly volatile fuel components has evaporated from the fuel in the fuel tank 10, and the fuel property has changed. Thus, in cases where the fuel temperature T is higher than the predetermined temperature T0, the ECU 20 carries out the processing of Steps S338, S340, and then S342 to store the data and hour of measurement and measure the fuel property.

At Step S338, the ECU 20 stores the present time and hour as the time at which concentration measurement was carried out. Then, in Step S340, the ECU 20 measures the concentration of evaporative fuel in the fuel tank 10 and measures the property of fuel in the fuel tank 10 from the measured evaporative fuel concentration.

Figure 4:
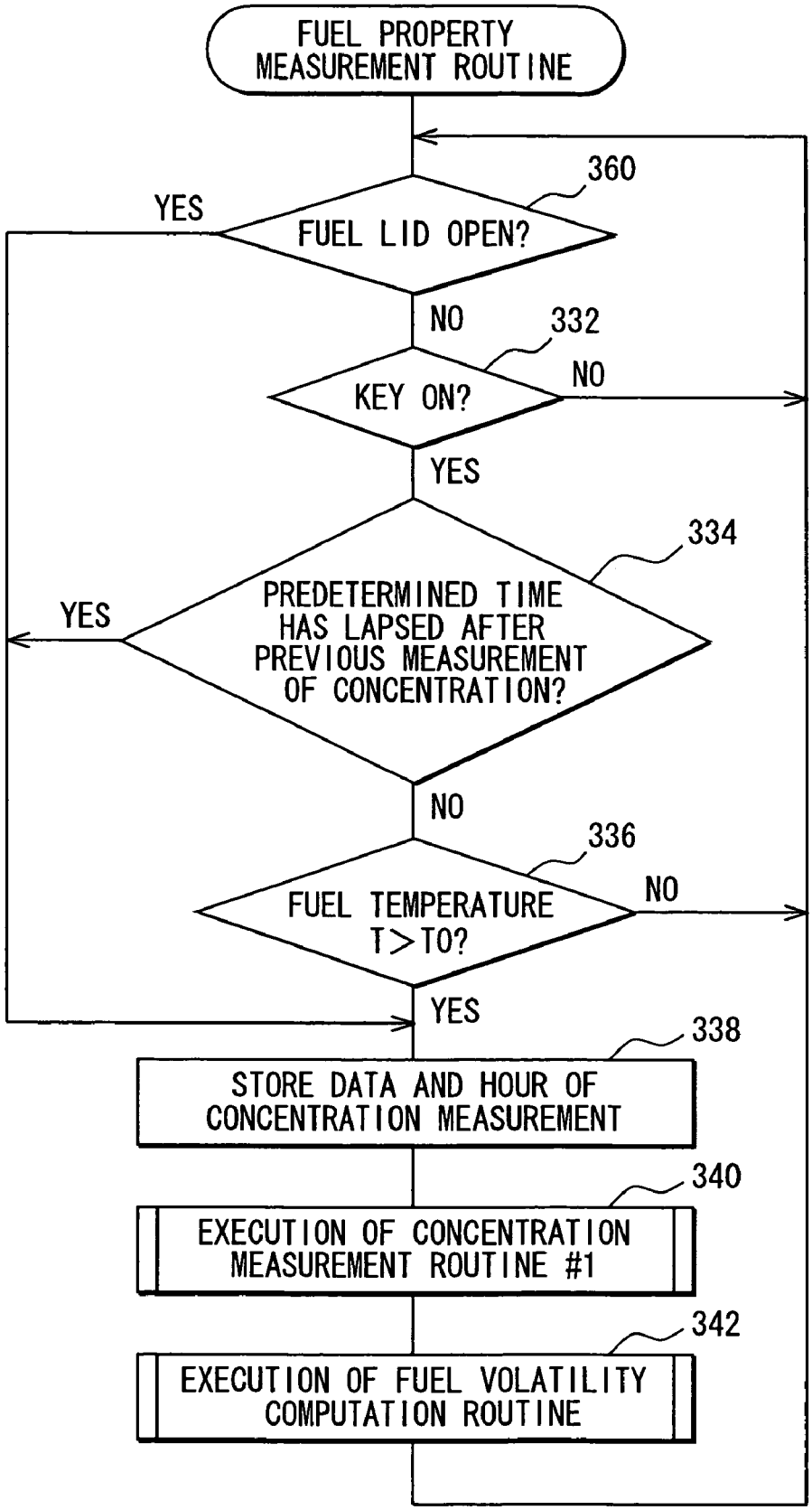
FIG. 4 is a flowchart illustrating another fuel property measurement routine for the evaporative fuel treatment apparatus of FIG. 1.

The fuel property measurement routine illustrated in FIG. 4 is similar to that of FIG. 3, except the ECU 20 does not carry out the processing of Step S330. Instead, as shown in FIG. 4, the ECU 20 determines at Step S360 whether or not the fuel lid is open. When the fuel lid is open, the ECU 20 determines that fuel is being fed into the fuel tank 10 and carries out the processing of Steps S338, S340, and S342 to store the date and hour of measurement and measure the fuel property.

Figure 5:
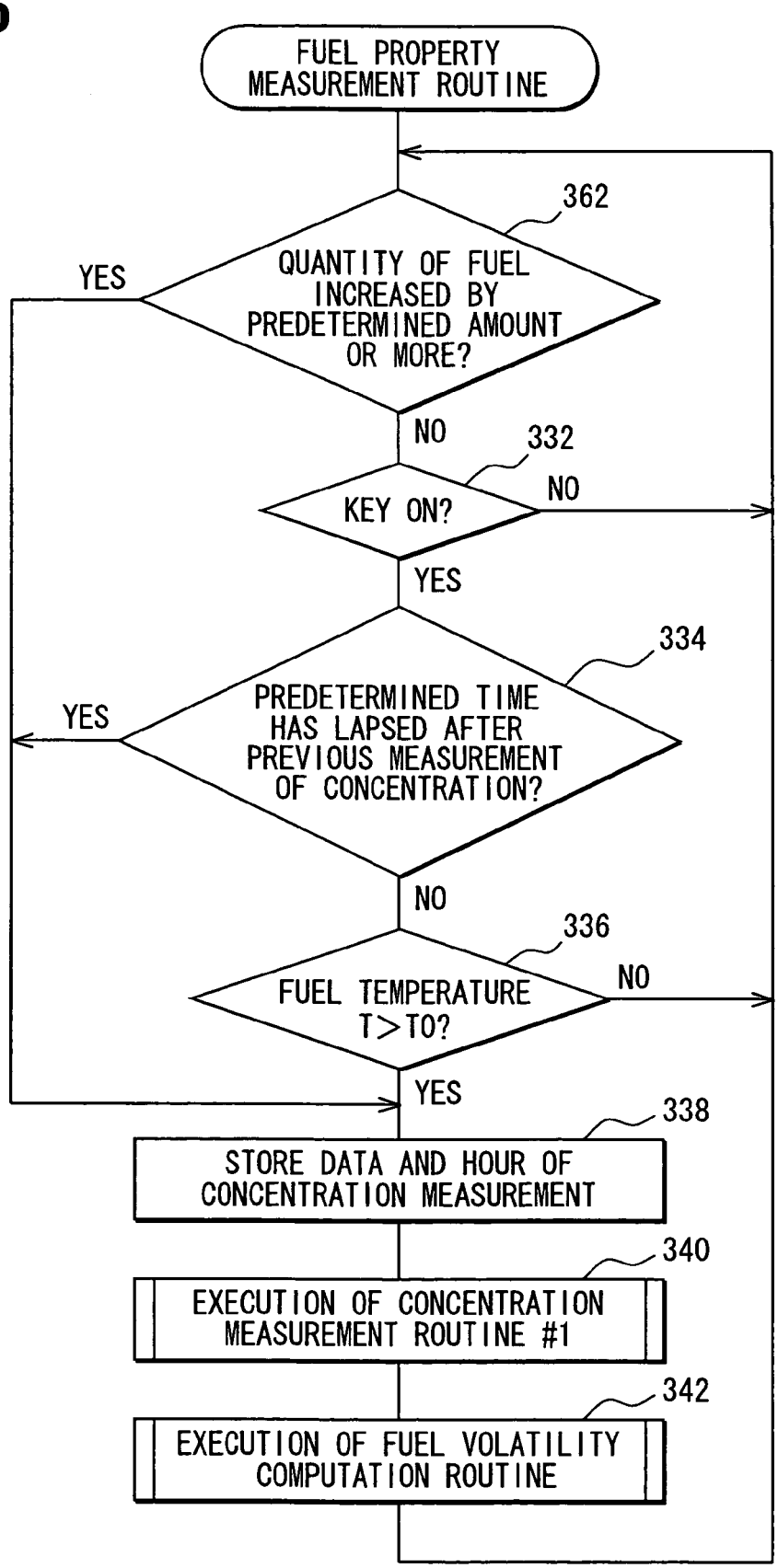
FIG. 5 is a flowchart illustrating another fuel property measurement routine for the evaporative fuel treatment apparatus of FIG. 1.

Furthermore, the fuel property measurement routine illustrated in FIG. 5 is similar to that of FIG. 3, except that the ECU 20 does not carry out the processing of Step S330. Instead, as shown in FIG. 5, the ECU 20 determines at Step S362 whether or not the quantity of fuel in the fuel tank 10 has been increased by a predetermined amount or more. In cases where the quantity of fuel has been increased by the predetermined amount or more, the ECU 20 determines that fuel is being fed into the fuel tank 10, and carries out the processing of Steps S338, S340, and S342 to store the date and hour of measurement and measure the fuel property.

Figure 6:
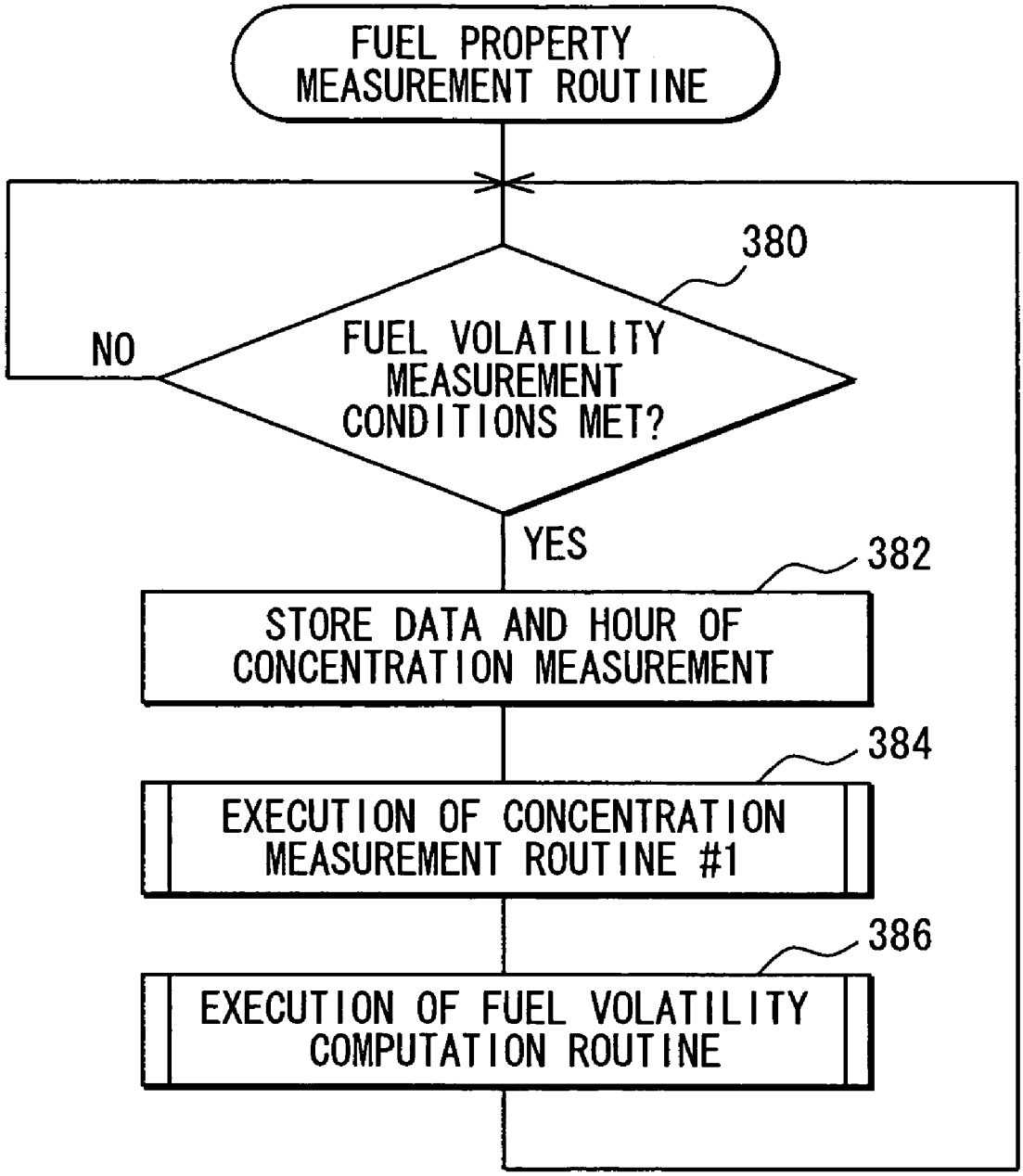
FIG. 6 is a flowchart illustrating another fuel property measurement routine for the evaporative fuel treatment apparatus of FIG. 1.

The fuel property measurement routine illustrated in FIG. 6 begins in Step S380, in which the ECU 20 determines whether or not fuel volatility measurement conditions have been met. The fuel volatility measurement conditions used at Step S380 are defined as conditions under which the property of fuel in the fuel tank 10 should be measured. Examples of the measurement conditions include whether or not fuel is being fed, whether or not the fuel temperature is higher than a predetermined temperature, whether or not a predetermined time has lapsed after the previous concentration measurement, and the like. In cases where the fuel volatility measurement conditions have been met (i.e., Step S380 is answered affirmatively), Steps S382, S384, and then S386 follow. In Steps S382, S384, and S386, the ECU 20 stores the date and hour of measurement and measures the fuel volatility (i.e., the fuel property).

It will be appreciated that by carrying out at least one of the fuel property measurement routines illustrated in FIG. 3 to FIG. 6, the property of fuel in the fuel tank 10 can be measured when fuel is fed into the fuel tank 10. Also, when the fuel volatility measurement conditions are met, the fuel property can be measured during normal operation after the internal combustion engine is started. Therefore, change in fuel property due to deterioration with age can be measured.

Concentration Measurement Routine #1

Figure 7:
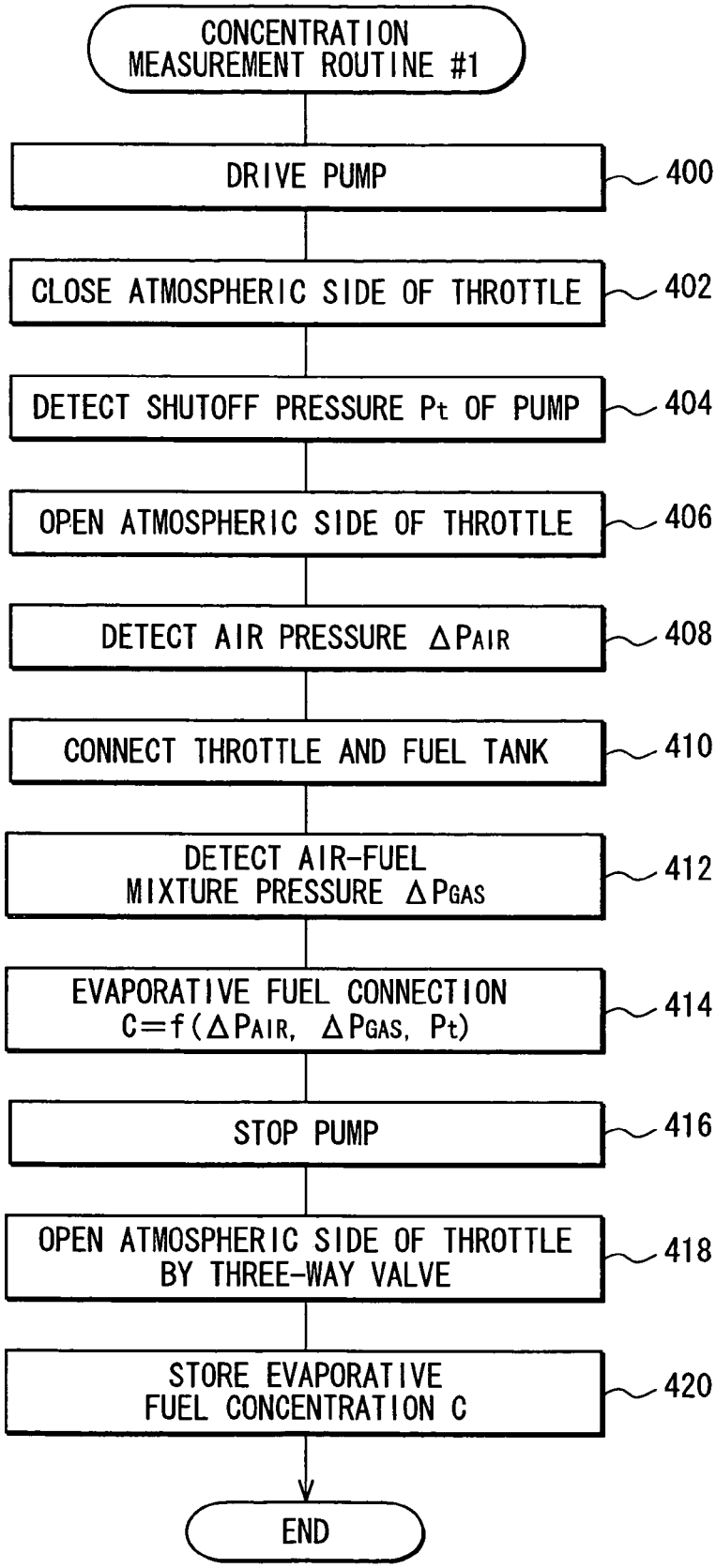
FIG. 7 is a flowchart illustrating a concentration measurement routine for the evaporative fuel treatment apparatus of FIG. 1.

A concentration measurement routine #1 is illustrated in FIG. 7. Using the routine the concentration of evaporative fuel in the fuel tank 10 is determined from shutoff pressure Pt, air pressure $\Delta P_{AIR}$, and air-fuel mixture pressure $\Delta P_{GAS}$.

Beginning in Step S400 of the routine illustrated in FIG. 7, the ECU 20 drives the pump 22. Then, in Step S402, the ECU 20 controls the switching of the electromagnetic valve 32 to close the measuring passage 112 on the side of the pump 22 opposite the throttle 30. That is, the ECU 20 closes the atmospheric side of the throttle 30. With the atmospheric side of the throttle 30 closed, the pressure detected by the pressure sensor 40 at Step S404 is the shutoff pressure Pt.

Then, in Step S406, the ECU 20 controls the switching of the electromagnetic valve 32 to open the measuring passage 112 on the side of the throttle 30 opposite the pump 22 to the air through the filter 24. In this state, only air passes through the throttle 30. Therefore, the pressure detected by the pressure sensor 40 at Step S408 is air pressure $\Delta P_{AIR}$.

Next, in Step S410, the ECU 20 controls the switching of the electromagnetic valve 32 to connect the measuring passage 112 on the side of the throttle 30 opposite the pump 22 to the passage 110 on the fuel tank 10 side. In this state, the air-fuel mixture of evaporative fuel and air in the fuel tank 10 passes through the throttle 30. Therefore, the pressure detected by the pressure sensor 40 at Step S412 is air-fuel mixture pressure $\Delta P_{GAS}$.

Subsequently, in Step S414, the ECU 20 computes the concentration C of evaporative fuel in the fuel tank 10 from the detected shutoff pressure Pt, the air pressure $\Delta P_{AIR}$, and the air-fuel mixture pressure $\Delta P_{GAS}$. Then, the ECU 20 stops the driving of the pump 22 in Step S416, and in subsequent step S418, the ECU 20 controls the switching of the electromagnetic valve 32 to open the measuring passage 112 on the side of the throttle 30 opposite the pump 22 to the air through the filter 24. Then, in Step S420, the ECU 20 stores the measured evaporative fuel concentration C in memory, such as RAM and the routine is terminated.

In this embodiment, the pump 22 is not controlled to a certain number of rotations. Therefore, when the differential pressure across the throttle 30 is increased and the load on the pump 22 is increased, the number of rotations of the pump 22 is reduced and its flow rate is reduced. Consequently, the atmospheric side of the throttle 30 is closed, and the shutoff pressure Pt of the pump 22 is detected. Then, the concentration of evaporative fuel in the fuel tank 10 is measured from shutoff pressure Pt, air pressure $\Delta P_{AIR}$, and air-fuel mixture pressure $\Delta P_{GAS}$. In cases where the pump 22 is controlled to a certain number of rotations, meanwhile, it is unnecessary to detect the shutoff pressure Pt. The concentration of evaporative fuel in the fuel tank 10 can be measured from air pressure $\Delta P_{AIR}$ and air-fuel mixture pressure $\Delta P_{GAS}$.

Fuel Volatility Computation Routine

The fuel volatility computation routine illustrated in FIG. 8 is a routine to compute the volatility (i.e., the fuel property) of fuel in the fuel tank 10. The volatility is computed from the concentration of evaporative fuel in the fuel tank 10 measured by concentration measurement routine #1 illustrated in FIG. 7.

Beginning in Step S440, the ECU 20 reads the evaporative fuel concentration C stored in memory (e.g., RAM) during Step S420 of the in concentration measurement routine #1 of FIG. 7. Then, in Step S442, the ECU 20 detects the atmospheric pressure Pa (i.e., the pressure in the fuel tank 10). To detect this atmospheric pressure Pa, the sensor output of the pressure sensor 40 open to the air may be used, or the atmospheric pressure may be detected by any other pressure sensor. Alternatively, the sensor output of a pressure sensor directly installed at the fuel tank 10 may be used.

Next, in Step S444, the ECU 20 computes the vapor pressure Pev in the fuel tank 10 from the evaporative fuel concentration C and atmospheric pressure Pa acquired at Steps S440 and S442. Specifically, the ECU 20 computes the vapor pressure Pev according to the following expression (i.e., Expression (1)):

$$C=Pev/Pa$$

Subsequently, at Step S446, the ECU 20 detects the temperature T of fuel in the fuel tank 10. Water temperature or intake air temperature may be used as fuel temperature T.

As illustrated in FIG. 9, the relationship between fuel temperature T and vapor pressure Pev differs from fuel to fuel. (In FIG. 9, fuels A, B, C, D, E, and F represent fuels different in property.) At Step S448, therefore, the ECU 20 computes the fuel property as fuel volatility RVP from vapor pressure Pev and fuel temperature T. Specifically, the ECU 20 computes the fuel volatility RVP according to the following expression (i.e., Expression (2)):

$$Pev=10^{[6.15-\{311\times(6.15-\log RVP)\}/(T+273.15)]}$$

Conversely, when fuel temperature T, vapor pressure Pev, and fuel volatility RVP are known, the evaporative fuel concentration C are computed by Expressions (1) and (2) shown above. As illustrated in FIG. 9A, the fuel volatility RVP is expressed as vapor pressure at 37.8° C. on a fuel property-by-fuel property basis.

Next, as shown in FIG. 8, Step S450 follows. In Step S450, the ECU 20 stores the computed fuel volatility RVP in memory (e.g., RAM).

Routine to Adjust Quantity of Evaporative Fuel Injected at Start

Figure 10:
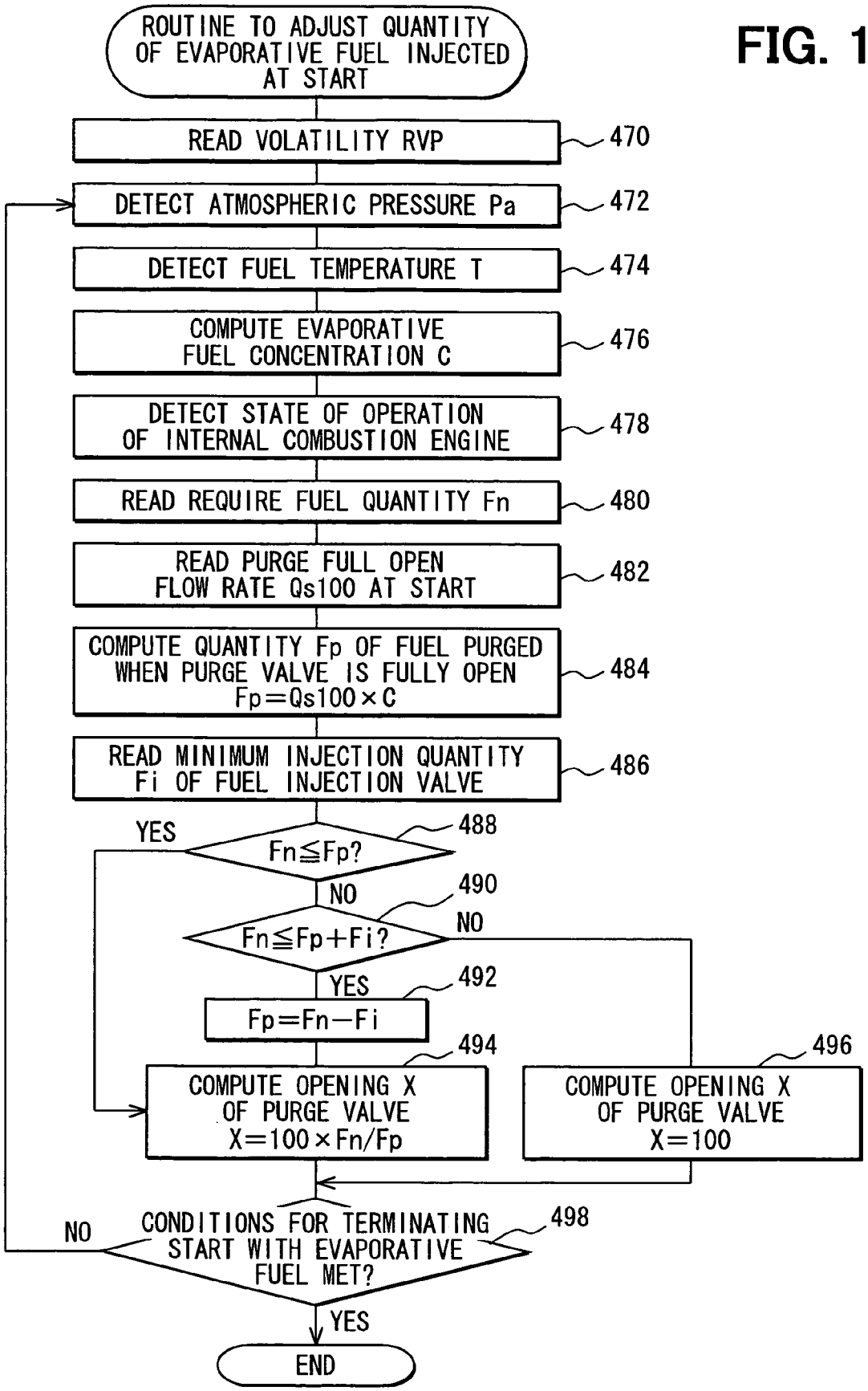
FIG. 10 is a flowchart illustrating a routing to adjust a quantity of evaporative fuel injected at engine start.

As shown in FIG. 10, the routine to adjust quantity of evaporative fuel injected at engine start begins in Step S470. At Step S470, the ECU 20 reads the fuel volatility RVP computed in the fuel volatility computation routine illustrated in FIG. 8. Then, in Step S472, the atmospheric pressure Pa is detected, and next the fuel temperature T is detected in Step S474. Subsequently, at Step S476, the ECU 20 computes the concentration C of evaporative fuel in the fuel tank 10 by Expressions (1) and (2) based on the atmospheric pressure Pa and fuel temperature T in the fuel tank 10 detected at Steps S472 and S474. At Step S478, the ECU 20 detects the state of operation of the internal combustion engine from various sensors. In one embodiment of Step S478, the ECU 20 detects number of engine revolutions, intake air quantity, intake pressure, and the like. Intake pressure may be computed from intake air quantity. Next, in Step S480, the ECU 20 reads a quantity Fn of fuel required for the internal combustion engine according to the state of operation of the internal combustion engine from a map or the like.

At Step S482, the ECU 20 reads from ROM, etc. a purge full open flow rate Qs100 when the internal combustion engine is started. Qs100 represents the quantity of air flowing in the purge passage 100 at the intake pressure of the intake path 12 immediately after the internal combustion engine is started when the fluid flowing in the purge passage 100 is approximately 100% air and the opening of the purge valve 16 is approximately 100%. Then, in Step S484, the ECU 20 computes the quantity Fp of evaporative fuel purged when the purge valve 16 is fully open by multiplying the purge full open flow rate Qs100 and the evaporative fuel concentration C.

At Step S486, the ECU 20 reads the minimum injection quantity Fi of the fuel injection valve. Then, in Step S488, the ECU 20 determines whether or not Fn is less than or equal to Fp (i.e., Fn≦Fp). When Fn is less than or equal to Fp (i.e., when Step S488 is answered affirmatively), the quantity of evaporative fuel purged when the purge valve 16 is fully opened is equal to or larger than the required fuel quantity. Therefore, the routine advances to Step S494, and the ECU 20 adjusts the opening of the purge valve 16. Specifically, where the opening of the purge valve 16 is X%, the ECU 20 computes X according to the following equation:

$$X=100\times(Fn/Fp)$$

If Fn is greater than Fp (i.e., Step S488 answered negatively), Fp is smaller than the required fuel quantity Fn. Therefore, the ECU 20 proceeds to Step S490, and determines whether or not Fn is less than or equal to the sum of Fp and Fi (i.e., Fn≦Fp+Fi). If Fn is less than or equal to the sum of Fp and Fi, then when the fuel injection valve injects the minimum injection quantity Fi, the quantity of evaporative fuel purged when the purge valve 16 is fully opened becomes equal to or larger than the required purge quantity. Therefore, at Step S492, the ECU 20 makes an adjustment so that Fp is equal to the difference between Fn and Fi (i.e., Fp=Fn−Fi). Next, at Step S494, the ECU 20 computes the opening of the purge valve 16, and carries out control with the opening of the purge valve set to X and the injection quantity of the fuel injection valve set to Fi. If Fn is greater than the sum of Fp and Fi (i.e., Step S490 answered negatively), then Step S496 follows, and the ECU 20 carries out control with the opening X% of the purge valve 16 set to 100 and the injection quantity F of the fuel injection valve set to Fn−Fp.

At Step S498, the ECU 20 purges the evaporative fuel in the fuel tank 10 into the internal combustion engine, and it is determined whether conditions exist for terminating the start with evaporative fuel. When, the conditions for starting the internal combustion engine cease, the ECU 20 terminates this routine. The conditions exist for terminating the engine start (i.e., Step S498 is answered affirmatively), for instance, when the number of engine revolutions is equal to or higher than a predetermined number of revolutions. If Step S498 is answered negatively, the ECU 20 returns to Step S472 and continues the processing as described above.

By executing the routine to adjust the quantity of evaporative fuel injected at start, an appropriate quantity of evaporative fuel can be purged into the intake path 12 based on the concentration of evaporative fuel in the fuel tank 10. This enhances the startability of the internal combustion engine.

Purge Routine #1

Figure 11:
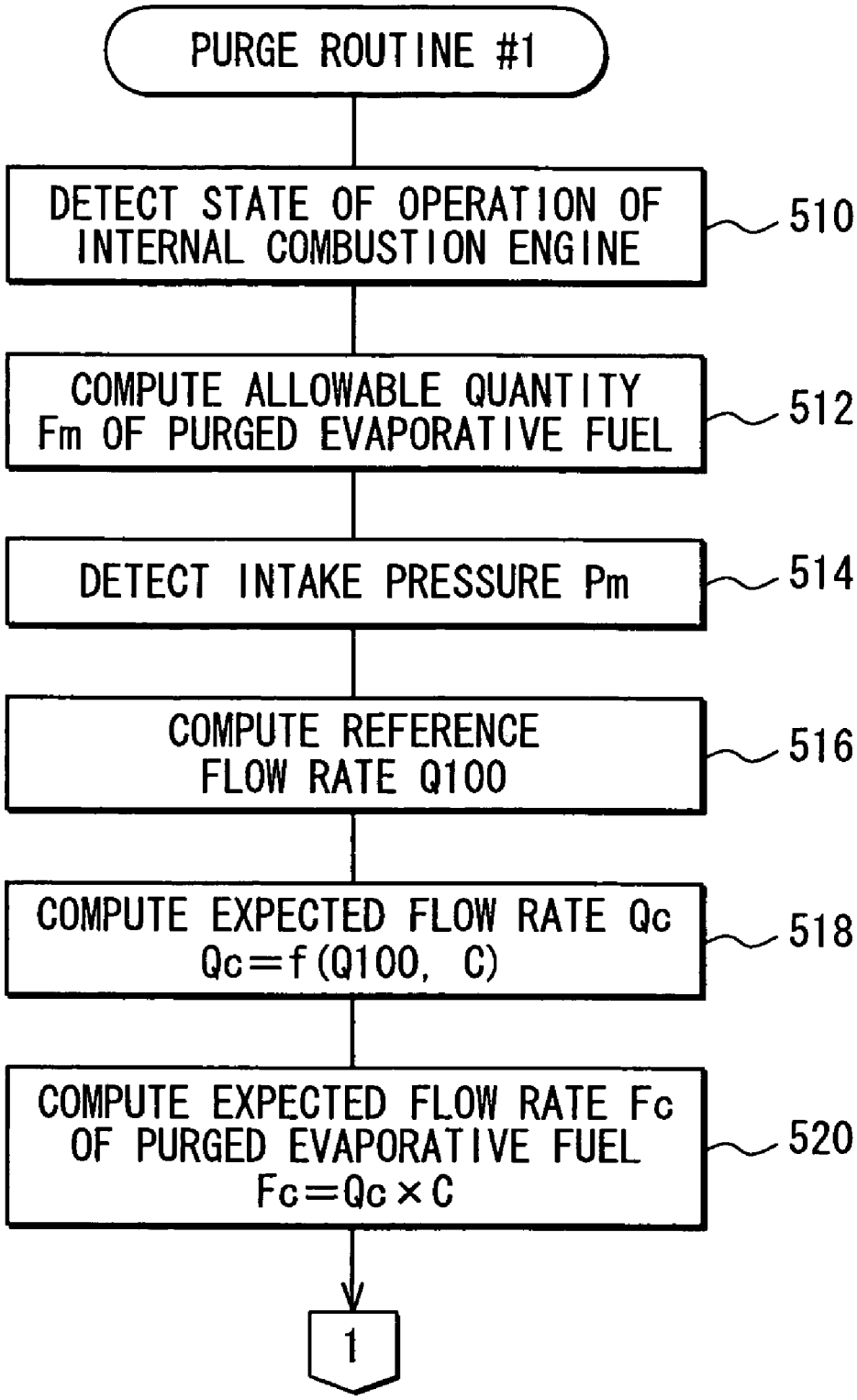
FIG. 11 is a flowchart illustrating a portion of a purge routine.
Figure 12:
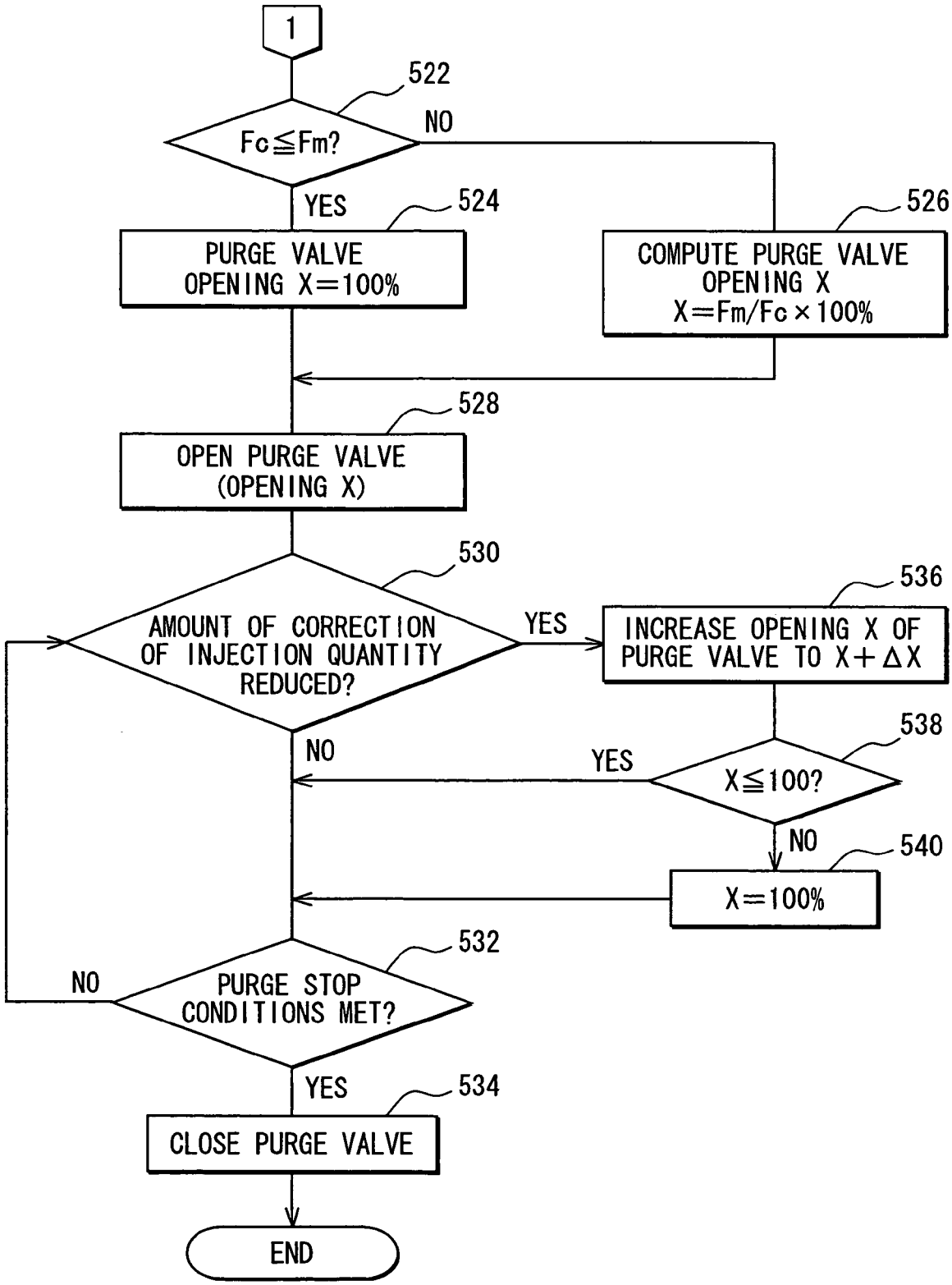
FIG. 12 is a flowchart illustrating another portion of the purge routine partially illustrated in FIG. 11.

Referring now to FIGS. 11 and 12, one embodiment of a purge routine #1 is illustrated. The routine starts at Step S510, wherein the ECU 20 detects the state of operation of the internal combustion engine. For instance, in Step S510, the ECU 20 detects the number of engine revolutions and intake air quantity.

Then, in Step S512, the ECU 20 computes an allowable quantity Fm to which evaporative fuel can be purged into the intake path 12. The allowable quantity Fm to which evaporative fuel can be purged into the intake path 12 is determined according to the state of operation of the internal combustion engine. At Step S514, the ECU 20 detects the intake pressure Pm of the intake path 12. The intake pressure Pm may be computed according to the intake air quantity detected at Step S510. At Step S516, the ECU 20 computes a reference flow rate Q100 defined according to the intake pressure Pm of the intake path 12. The reference flow rate Q100 represents the quantity of air flowing in the purge passage 100 at the present intake pressure Pm of the intake path 12 when the fluid flowing in the purge passage 100 is approximately 100% air and the opening of the purge valve 16 is approximately 100%.

Next, in Step S518, the ECU 20 computes an expected flow rate Qc from the reference flow rate Q100 and the evaporative fuel concentration C. The expected flow rate Qc represents the flow rate of air-fuel mixture of the evaporative fuel concentration C flowing in the purge passage 100 with the opening of the purge valve 16 set to approximately 100%. At Step S520, the ECU 20 computes a flow rate Fc of evaporative fuel flowing in the purge passage 100 from the expected flow rate Qc and the evaporative fuel concentration C with the opening of the purge valve 16 set to approximately 100%.

At Step S522 shown in FIG. 12, the ECU 20 determines whether or not Fc is less than or equal to Fm (i.e., Fc≦Fm). When Fc is less than or equal to Fm, the flow rate Fc of evaporative fuel does not exceed the allowable quantity Fm. Therefore, when Step S522 is answered affirmatively, Step S524 follows, and the ECU 20 sets the opening of the purge valve 16 to approximately 100%. In cases where the opening of the purge valve 16 is set to approximately 100% when the flow rate Fc of evaporative fuel exceeds the allowable quantity, evaporative fuel is excessively purged into the intake path 12. In this case, therefore, the ECU 20 adjusts the opening of the purge valve 16 at Step S526. Specifically, where the opening of the purge valve 16 is X%, the ECU 20 sets X according to the following equation:

$$(Fm/Fc)\times 100$$

Next, in Step S528, the ECU 20 opens the purge valve 16 according to the set opening. The quantity of evaporative fuel purged from the fuel tank 10 is determined according to the opening of the purge valve 16. The injection quantity of the fuel injection valve is corrected from the initial value of injection quantity set before purging is started, based on the quantity of purged evaporative fuel. When evaporative fuel is purged from the fuel tank 10 and, as a result, the quantity of evaporative fuel in the fuel tank 10 is reduced, the quantity of evaporative fuel purged from the fuel tank 10 into the intake path 12 is reduced, and the air fuel ratio is lowered. The injection quantity of the fuel injection valve is corrected by feeding back the air fuel ratio. Therefore, when the quantity of evaporative fuel purged from the fuel tank 10 into the intake path 12 is reduced and the air fuel ratio is lowered, the following measure is taken to increase the air fuel ratio: the injection quantity of the fuel injection valve is so set that it is increased. As a result, the amount of correction of injection quantity, which is equivalent to the difference between the set injection quantity and the initial value of injection quantity, is reduced.

At Step S530, consequently, the ECU 20 determines whether or not the amount of correction of injection quantity has been reduced. In cases where the amount of correction of injection quantity has not been reduced, that is, when the air fuel ratio has not been lowered and the quantity of purged evaporative fuel has not been reduced, the ECU 20 determines whether or not purge stop conditions have been met (Step S532). In cases where the purge stop conditions have not been met, the ECU 20 returns to the processing of the Step S530 and continues purging. In cases where the purge stop conditions have been met, the ECU 20 closes the purge valve 16 (Step S534) and terminates the purge routine.

In cases where the ECU 20 determines at Step S530 that the amount of correction of injection quantity has been reduced, that is, when the air fuel ratio has been lowered and the quantity of purged evaporative fuel has been reduced, the ECU 20 increases the opening of the purge valve 16 to increase the quantity of evaporative fuel purged from the fuel tank 10 (Step S536). The opening of the purge valve 16 is set to approximately 100% (Steps S538 and S540). After setting the opening of the purge valve 16, the ECU 20 carries out the determination of Step S532.

Purge Routine #2

Figure 13:
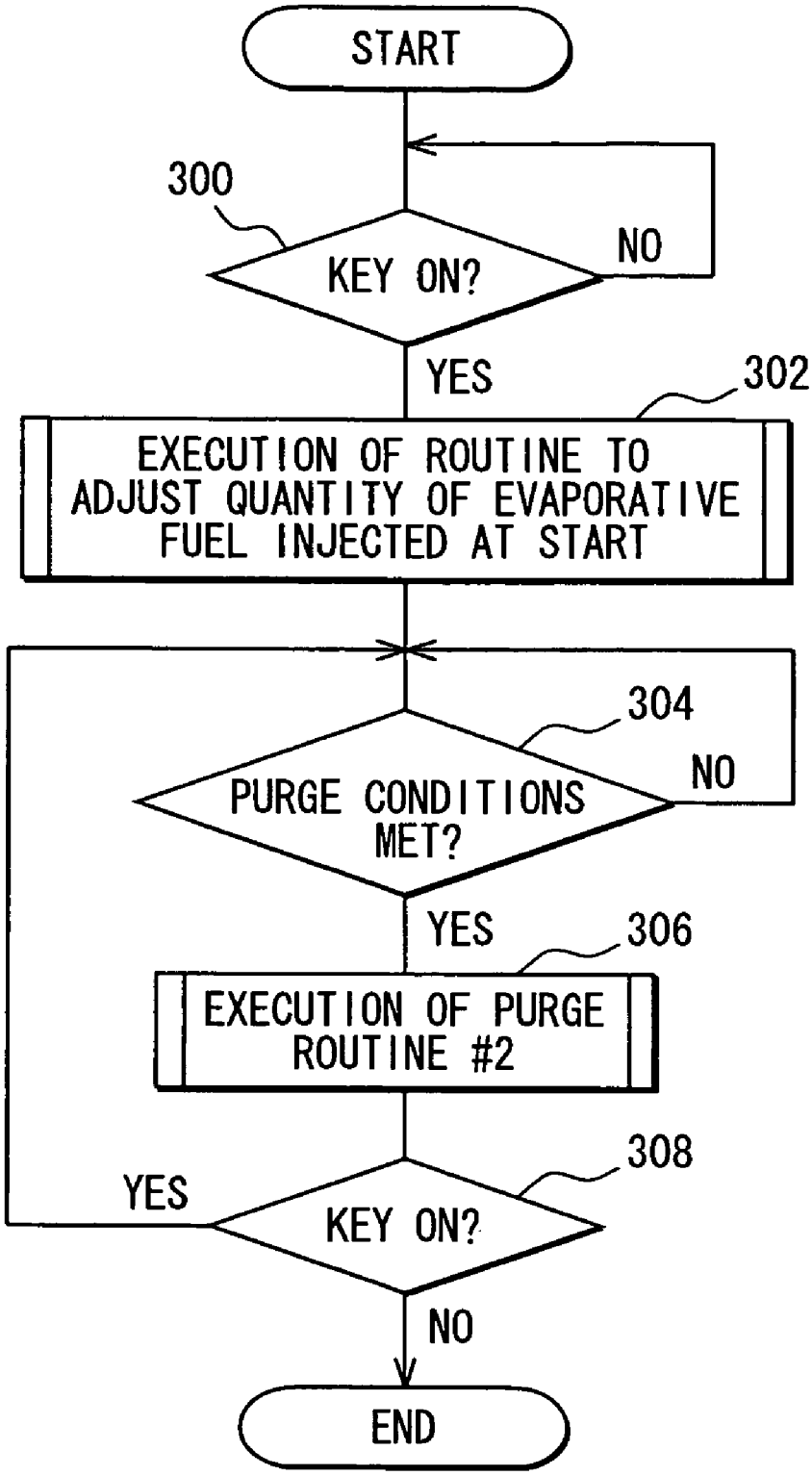
FIG. 13 is a flowchart illustrating another main routine carried out when a purge routine illustrated in FIGS. 14 and 15 is executed.
Figure 14:
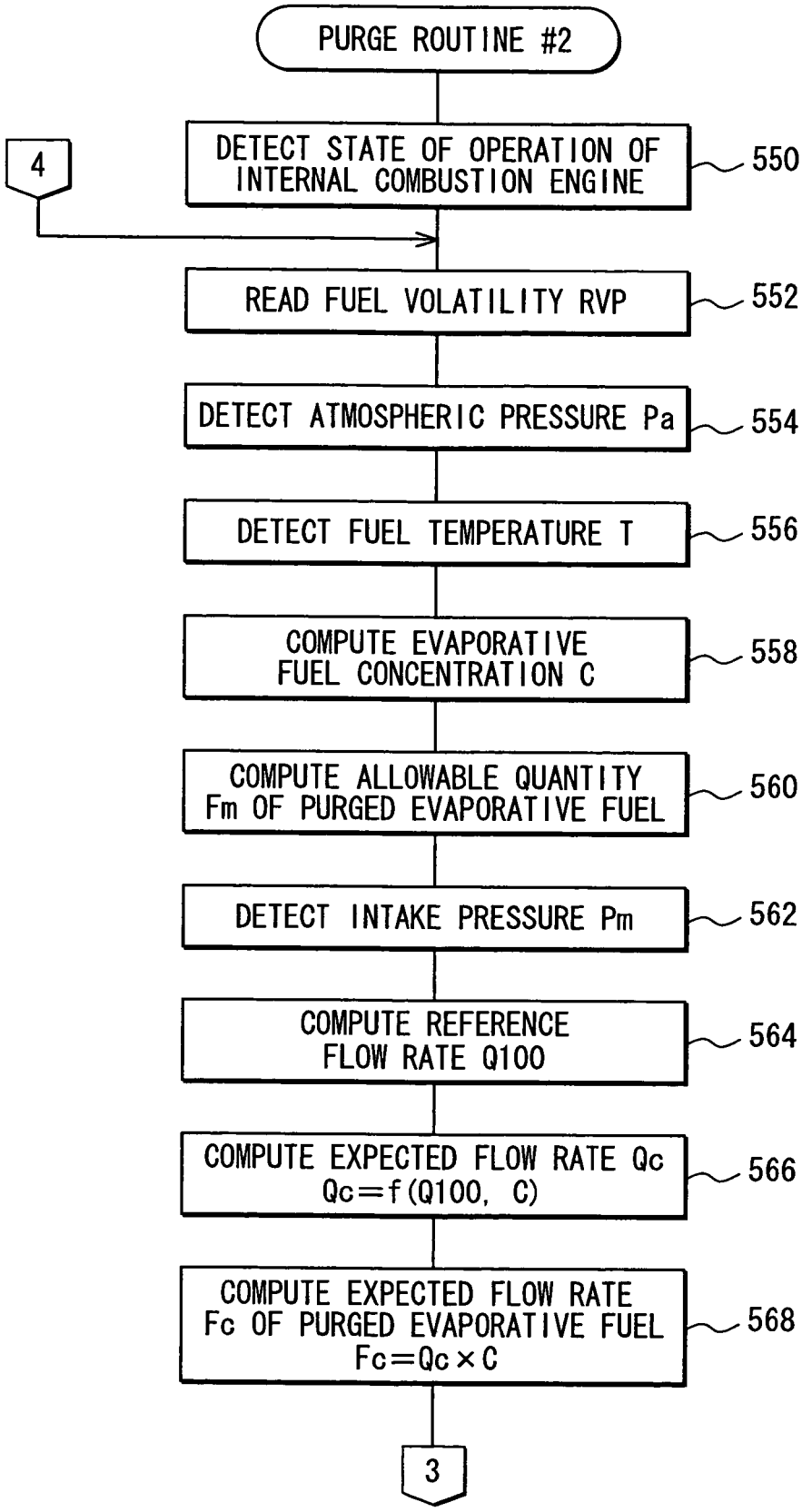
FIG. 14 is a flowchart illustrating a portion of another purge routine.
Figure 15:
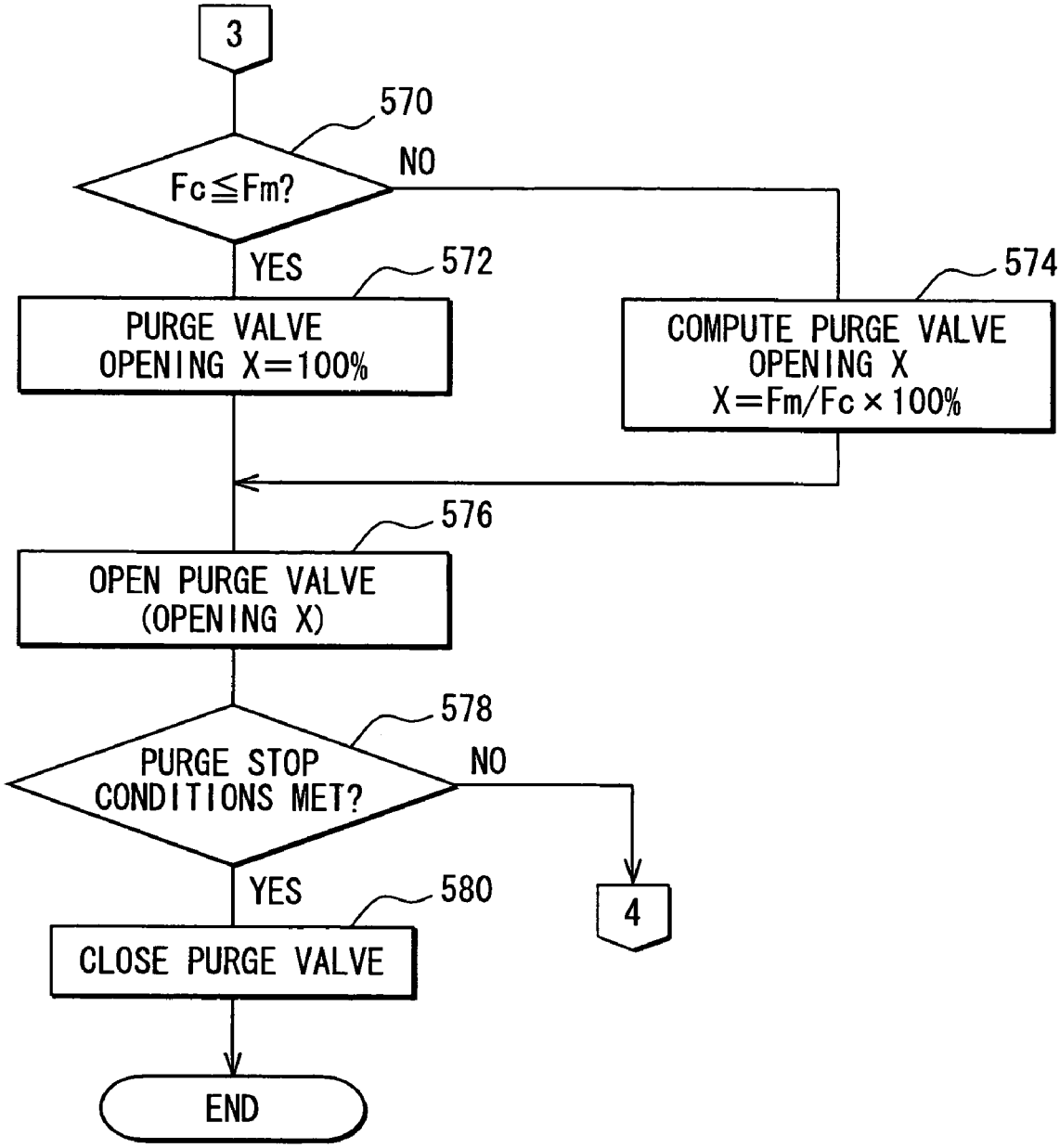
FIG. 15 is a flowchart illustrating another portion of the purge routine partially illustrated in FIG. 14.

Purge routine #2 illustrated in FIGS. 14 and 15 may be carried out in place of purge routine #1 illustrated in FIGS. 11 and 12. In purge routine #2, the concentration of evaporative fuel in the fuel tank 10 is computed during the routine. Therefore, in cases where purge routine #2 is carried out, main routine #2 illustrated in FIG. 13 is carried out. In main routine #2 illustrated in FIG. 13, the step at which evaporative fuel concentration is computed in main routine #1 illustrated in FIG. 2 is omitted.

Steps S550 and S560 to S576 of purge routine #2 illustrated in FIGS. 14 and 15 correspond to Steps S510 to S528 of purge routine #1 illustrated in FIGS. 11 and 12, and at these steps, the same processing is carried out. When the ECU 20 detects at Step S550 the state of operation of the internal combustion engine, the ECU 20 computes the concentration C of evaporative fuel in the fuel tank 10 at Steps S552 to S558 and proceeds to the processing of Step S560.

In purge routine #2, the feedback control of the opening of the purge valve 16 by air fuel ratio, carried out in purge routine #1, is not carried out. Instead, in purge routine #2, when the ECU 20 determines at Step S578 that the purge stop conditions have not been met, it returns to the processing of Step S552. Then, the ECU 20 computes the evaporative fuel concentration C to control the opening of the purge valve 16. In cases where the purge stop conditions have been met, the ECU 20 closes the purge valve 16 (Step S580) and terminates purge routine #2.

Figure 16:
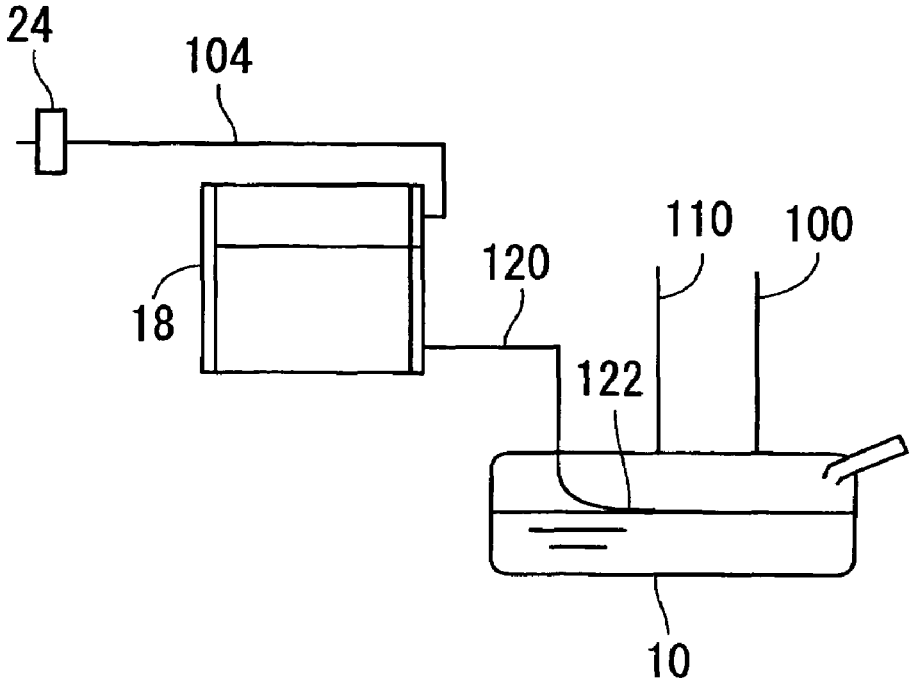
FIG. 16 is a schematic diagram illustrating another embodiment of a communicating pipe for the evaporative fuel treatment apparatus.

FIG. 16 illustrates another embodiment. Component parts that are similar to those in the above-described embodiment are indicated in FIG. 16 with corresponding reference numerals.

The pipe end portion 122 on the fuel tank 10 side of the communicating pipe 120 that couples the canister 18 and the fuel tank 10 is formed of, for example, expandable resin. The pipe end portion 122 is buoyant and floats on the surface of fuel. Therefore, the pipe end portion 122 floats on the surface of fuel even when the quantity of fuel in the fuel tank 10 is increased or decreased.

With this construction, fresh air is introduced from the canister 18 to the vicinity of the surface of the fuel in the fuel tank 10 even during desorption of the evaporative fuel from the canister 18. The concentration of evaporative fuel in proximity to the surface of fuel is lowered by the fresh air introduced above the surface of the fuel, and thus the fuel is further evaporated. Therefore, even when the evaporative fuel in the fuel tank 10 is purged into the intake path 12, the concentration of evaporative fuel in the fuel tank 10 can be increased (e.g., saturated).

In one embodiment, an outflow prevention valve is installed between the pipe end portion 122 and the canister 18, which valve prevents fuel from flowing out if the vehicle rolls over. This outflow prevention valve may also be installed in the purge passage 100 and the passage 110.

Figure 17:
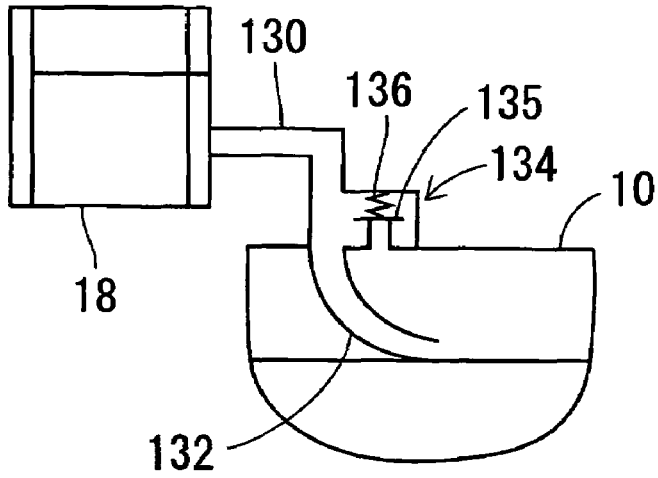
FIG. 17 is a schematic diagram illustrating another embodiment of a check valve for the evaporative fuel treatment apparatus.
Figure 18:
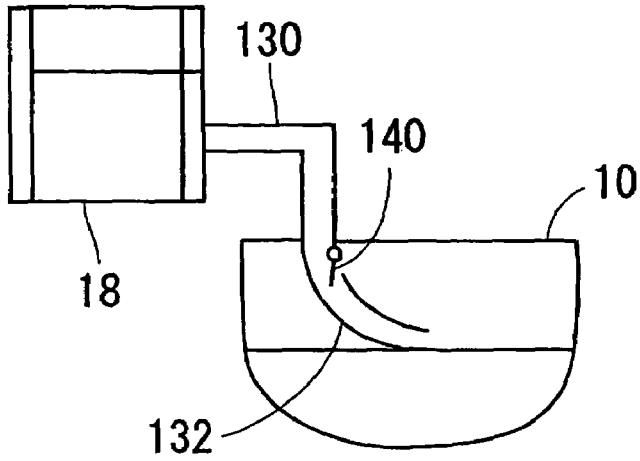
FIG. 18 is a schematic diagram illustrating another embodiment of a check valve for the evaporative fuel treatment apparatus.

FIG. 17 illustrates an additional embodiment of the invention, and FIG. 18 illustrates still another embodiment. Component parts that are similar to those in the above-described embodiment are indicated in the Figures with corresponding reference numerals.

In the embodiment illustrated in FIG. 17, the pipe end portion 132 on the fuel tank 10 side of the communicating pipe 130 that couples the canister 18 and the fuel tank 10 is formed of, for instance, expandable resin so that it is thin. Similar to the embodiment of FIG. 16, therefore, the pipe end portion 132 is buoyant and floats on the surface of fuel in the fuel tank 10. Further, the pipe end portion 132 has backflow prevention structure. Because of this structure, the pipe end portion permits the flow of fluid from the canister 18 toward the fuel tank 10, but it is closed by fuel pressure when the fuel in the fuel tank 10 is about to go into the pipe end portion 132 during fueling or on other like occasions. Therefore, fuel can be prevented from flowing in the communicating pipe 130 from the fuel tank 10 back toward the canister 18.

However, when the pipe end portion 132 is closed during fueling, the evaporative fuel produced in the fuel tank 10 during fueling cannot be absorbed into the canister 18 through the communicating pipe 130. Therefore, a check valve 134 with a valve member 135 is installed above the fuel tank 10. This check valve is so constructed that the valve member 135 is lifted by the pressure of the evaporative fuel in the fuel tank 10 against the biasing load of a spring 136, and it permits the evaporative fuel to flow in the communicating pipe 130 toward the canister 18. The check valve 134 is closed such that, when fluid flows from the canister 18 to the fuel tank 10 and fresh air is introduced from the canister 18 into the fuel tank 10, the fresh air is prevented from flowing to the upper part of the fuel tank 10 through the check valve 134 and flowing out into the purge passage 100.

The check valve 140 in the embodiment illustrated in FIG. 18 is similar to that shown in FIG. 17. However, the valve structure does not receive the biasing load of a spring member or the like.

Figure 19:
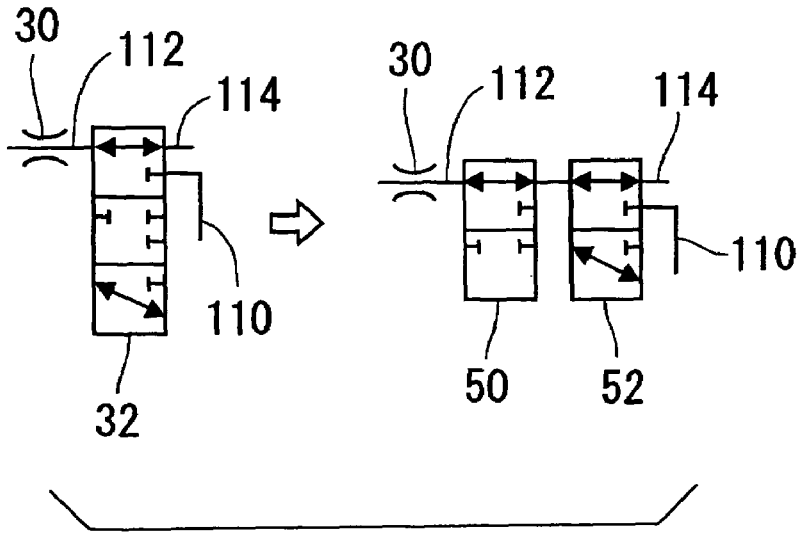
FIG. 19 is a schematic diagram illustrating another embodiment of a selector valve for the evaporative fuel treatment apparatus.

FIG. 19 illustrates another embodiment of the invention. Components that are similar to those of the above-described embodiments are marked with corresponding numerals. In this embodiment, a selector valve is constructed by combining an electromagnetic valve 50 and an electromagnetic valve 52, in place of the electromagnetic valve 32 in the first embodiment.

Figure 20:
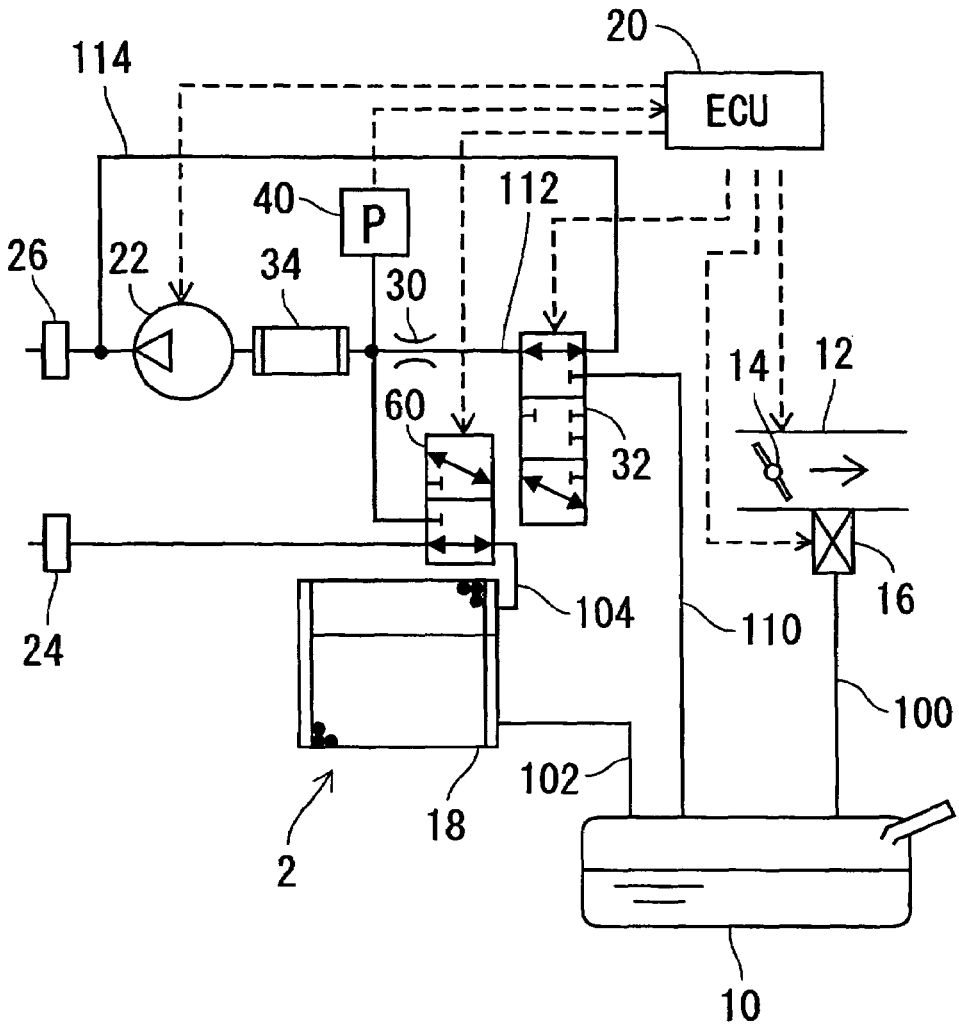
FIG. 20 is a schematic diagram of another embodiment of the evaporative fuel treatment apparatus.

FIG. 20 illustrates another embodiment of the invention. Components that are similar to those of the above-described embodiments are marked with corresponding numerals. In the evaporative fuel treatment apparatus 2, an electromagnetic valve 60 is installed between the measuring passage 112 between the throttle 30 and the second canister 34, and the canister 18. The electromagnetic valve 60 is installed for checking for leakage in the purge system constructed of the canister 18, passage 102, fuel tank 10, and purge passage 100. In this embodiment, the throttle 30 is so set that its bore diameter is equivalent to the amount of leakage allowed for the purge system, and is also used as reference throttle for leakage check.

When the passage of current is turned on, the electromagnetic valve 60 is brought into a state of switching in which the measuring passage 112 between the throttle 30 and the second canister 34 and the canister 18 are fluidly coupled. When leakage check is not conducted, the passage of current through the electromagnetic valve 60 remains off. When the passage of current is off, the electromagnetic valve 60 is in the state of switching illustrated in FIG. 20. As such, the canister 18 is open to the air by the passage 104.

When the purge valve 16 is closed and the pump 22 is actuated with the electromagnetic valves 32 and 60 in the state illustrated in FIG. 20, the pressure detected by the pressure sensor 40 makes the reference pressure for determining leakage in the purge system.

Then, the passage of current through the electromagnetic valve 60 is turned on to connect the measuring passage 112 between the throttle 30 and the second canister 34 with the canister 18. Further, the switching of the electromagnetic valve 32 is controlled to close the measuring passage 112 on the side of the throttle 30 opposite the pump 22. Leakage in the purge system is checked by actuating the pump 22 in this state and comparing the pressure detected by the pressure sensor 40 with the previously detected reference pressure.

Figure 21:
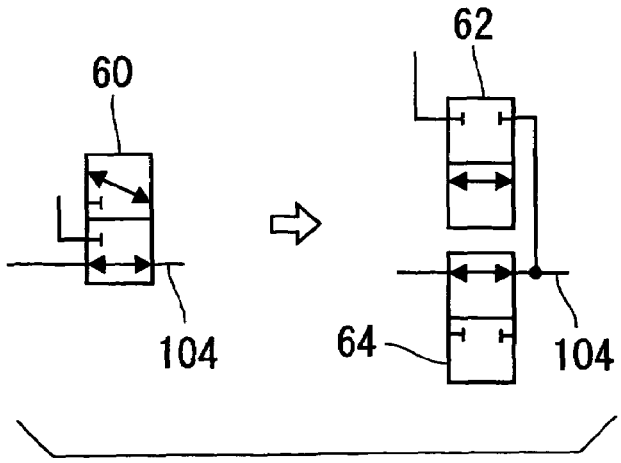
FIG. 21 is a schematic diagram illustrating another embodiment of a valve for the evaporative fuel treatment apparatus.

FIG. 21 illustrates another embodiment of the invention. Components that are similar to those of the above-described embodiments are marked with corresponding numerals. In the seventh embodiment, a combination of an electromagnetic valve 62 and an electromagnetic valve 64 is used in place of the electromagnetic valve 60 in the embodiment of FIG. 20.

Figure 22:
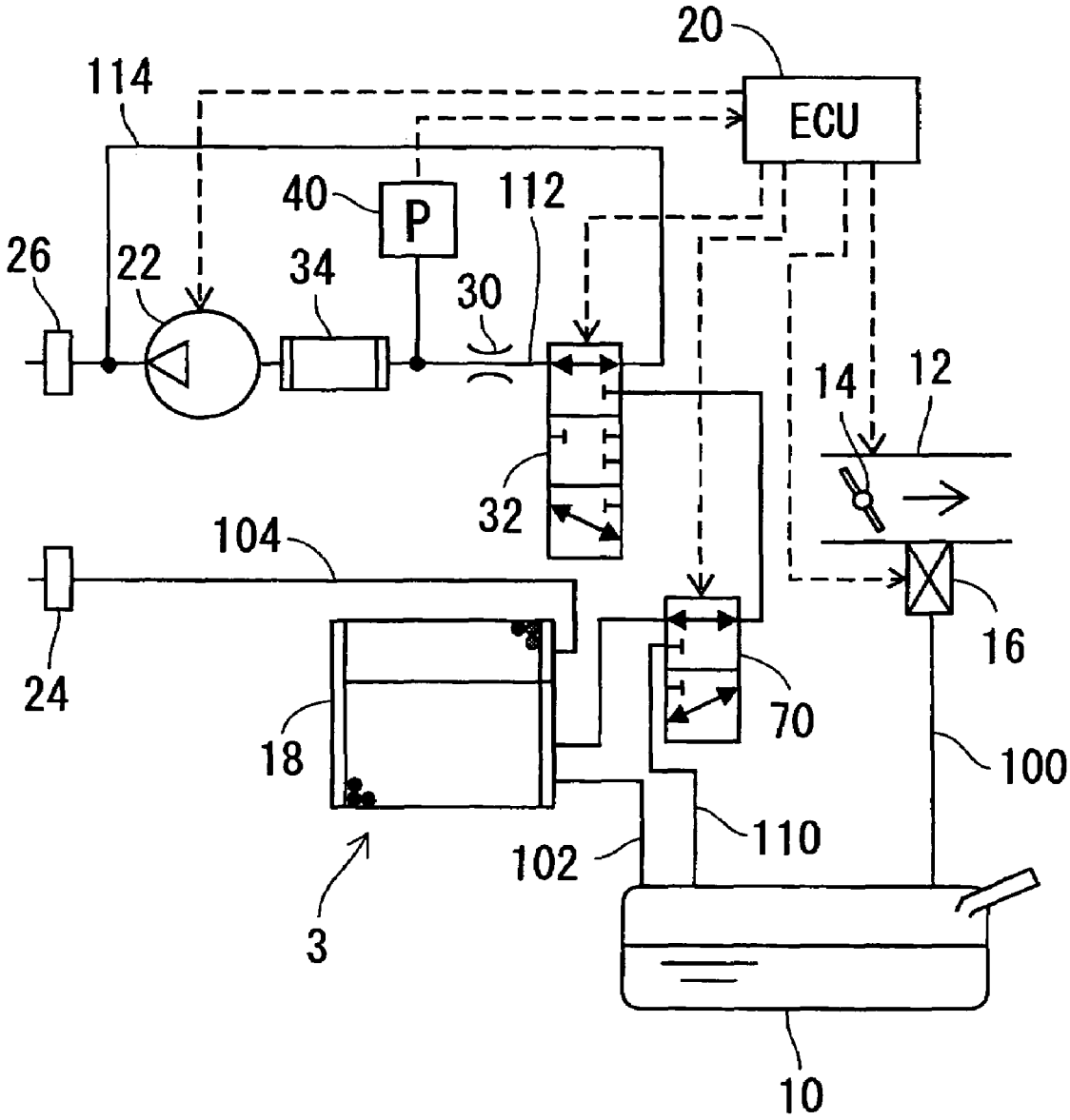
FIG. 22 is a schematic diagram of another embodiment of the evaporative fuel treatment apparatus.

FIG. 22 illustrates another embodiment of the invention. Components that are similar to those of the above-described embodiments are marked with corresponding numerals. In the embodiment of FIG. 22, switching is implemented by combining the electromagnetic valve 32 and an electromagnetic valve 70 to construct a selector valve. Specifically, switching occurs to change communication between the throttle 30 and the air; communication between the throttle 30 and the fuel tank 10; communication between the throttle 30 and the canister 18; and closure of the measuring passage 112 on the side of the throttle 30 opposite the pump 22, that is, closure of the atmospheric side of the throttle 30.

With the construction of this embodiment, the concentration of evaporative fuel absorbed in the canister 18 is measured, in addition to the concentration of evaporative fuel in the fuel tank 10. When the passage of current is off, the electromagnetic valves 32 and 70 are in the state illustrated in FIG. 22.

Main Routine #3

Figure 23:
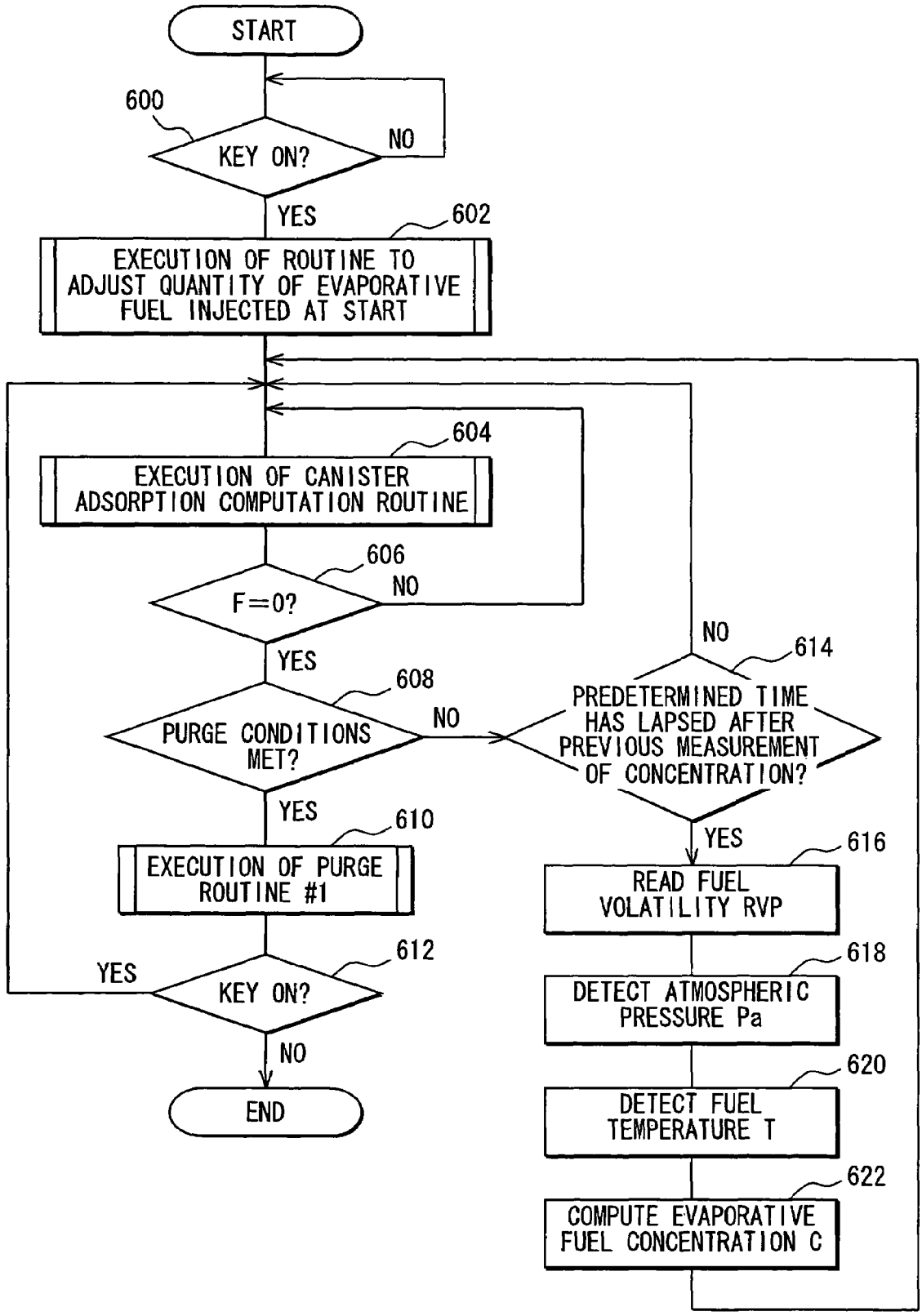
FIG. 23 is a flowchart illustrating another embodiment of a main routine for the evaporative fuel treatment apparatus of FIG. 22.

Referring now to FIG. 23, a main routine #3 is illustrated for carrying out the following processing in the embodiment of FIG. 22. Specifically, using the main routine #3, the concentration of evaporative fuel in the fuel tank 10 and the concentration of evaporative fuel in the canister 18 are computed, and the quantity of evaporative fuel purged from the fuel tank 10 into the intake path 12 is controlled. Steps S600, S602, and S608 to S622 of main routine #3 illustrated in FIG. 23 respectively correspond to Steps S300 to S318 of main routine #1 illustrated in FIG. 2, and at these steps, substantially the same processing is carried out.

In main routine #3 illustrated in FIG. 23, the ECU 20 measures the adsorption of the canister 18 at Step S604 before it determines at Step S608 whether or not purge conditions have been met. That is, the ECU 20 measures the concentration of evaporative fuel absorbed in the canister 18. At Step S606, the ECU 20 determines the concentration of evaporative fuel in the canister 18 by the value of purge stop flag F set in the canister adsorption computation routine of Step S604. When this determination reveals that the concentration of evaporative fuel in the canister 18 is higher than a predetermined value, the ECU 20 determines at Step S608 whether or not the purge execution conditions have been met. When the concentration of evaporative fuel in the canister 18 is equal to or lower than the predetermined value, the ECU 20 proceeds to the processing of Step S614, and does not carry out purge routine #1. That is, when the concentration of evaporative fuel in the canister 18 is equal to or lower than the predetermined value, the ECU 20 does not open the purge valve 16. As mentioned above, the ECU 20 determines whether to carry out purge processing according to the concentration of evaporative fuel in the canister 18. Therefore, evaporative fuel is prevented from being constantly purged from the fuel tank 10 when the purge conditions have been met. This prevents highly volatile fuel components from being excessively purged from the fuel tank 10, and suppresses an increase in the ratio of low-volatility fuel components in the fuel in the fuel tank. Therefore, it is possible to prevent deterioration in the atomization of fuel spray injected from the fuel injection valve.

Canister Adsorption Computation Routine

Figure 24:
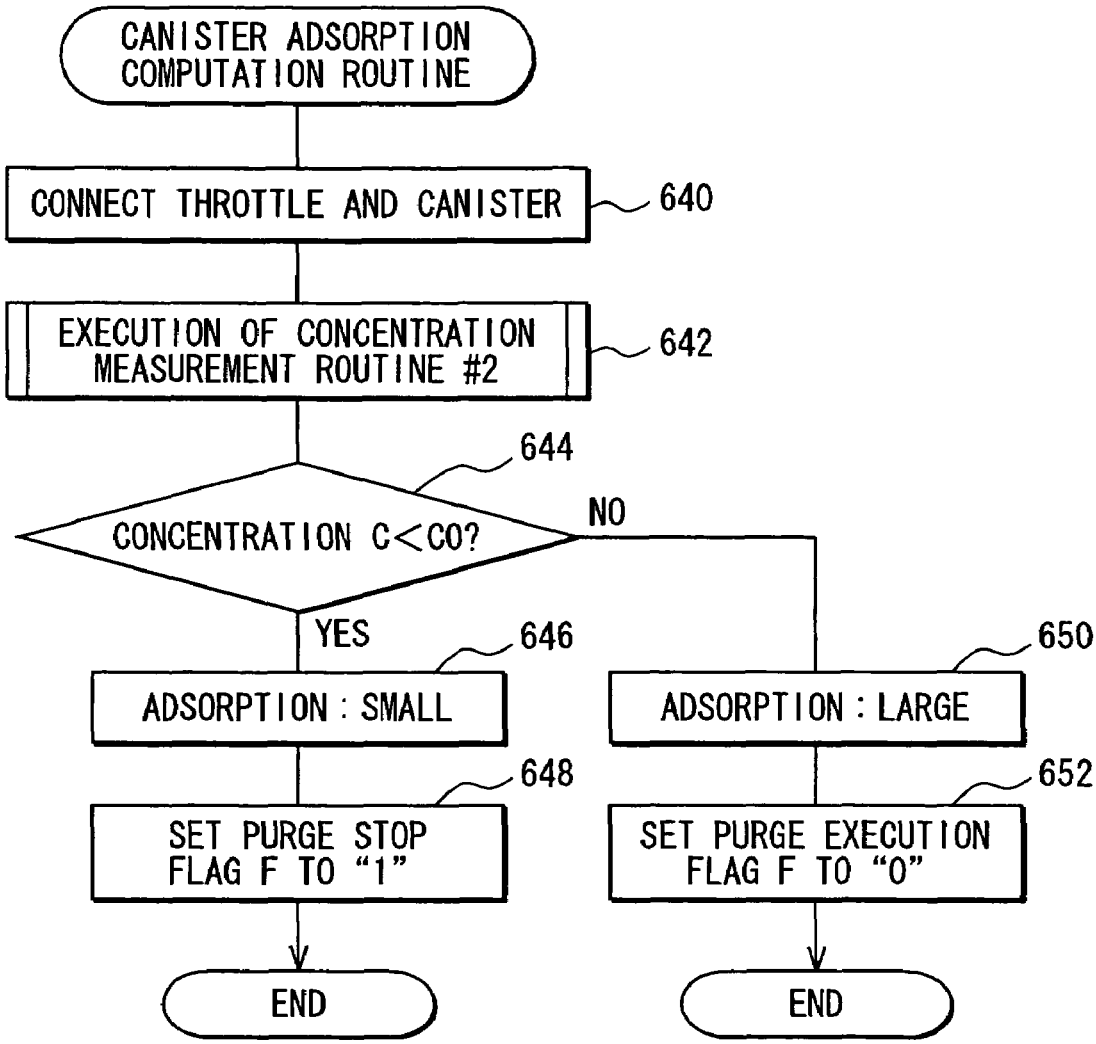
FIG. 24 is a flowchart illustrating a canister adsorption computation routine for the evaporative fuel treatment apparatus.

At Step S640 of the routine illustrated in FIG. 24, the ECU 20 turns on the passage of current through the electromagnetic valve 70 when the electromagnetic valves 32 and 70 are in the state illustrated in FIG. 22 to connect the throttle 30 and the canister 18. At Step S642, the ECU 20 carries out concentration measurement routine #2 to measure the concentration of evaporative fuel in the canister 18.

When the measured concentration C of evaporative fuel in the canister 18 is lower than a predetermined value C0 at Step S644, the ECU 20 determines that the quantity of evaporative fuel absorbed in the canister 18 is small (Step S646), and sets the purge stop flag F to "1" at Step S648. When the measured concentration C of evaporative fuel in the canister 18 is equal to or higher than the predetermined value C0, the ECU 20 determines that the quantity of evaporative fuel absorbed in the canister 18 is large (Step S650), and sets the purge stop flag F to "0" at Step S652.

Figure 25:
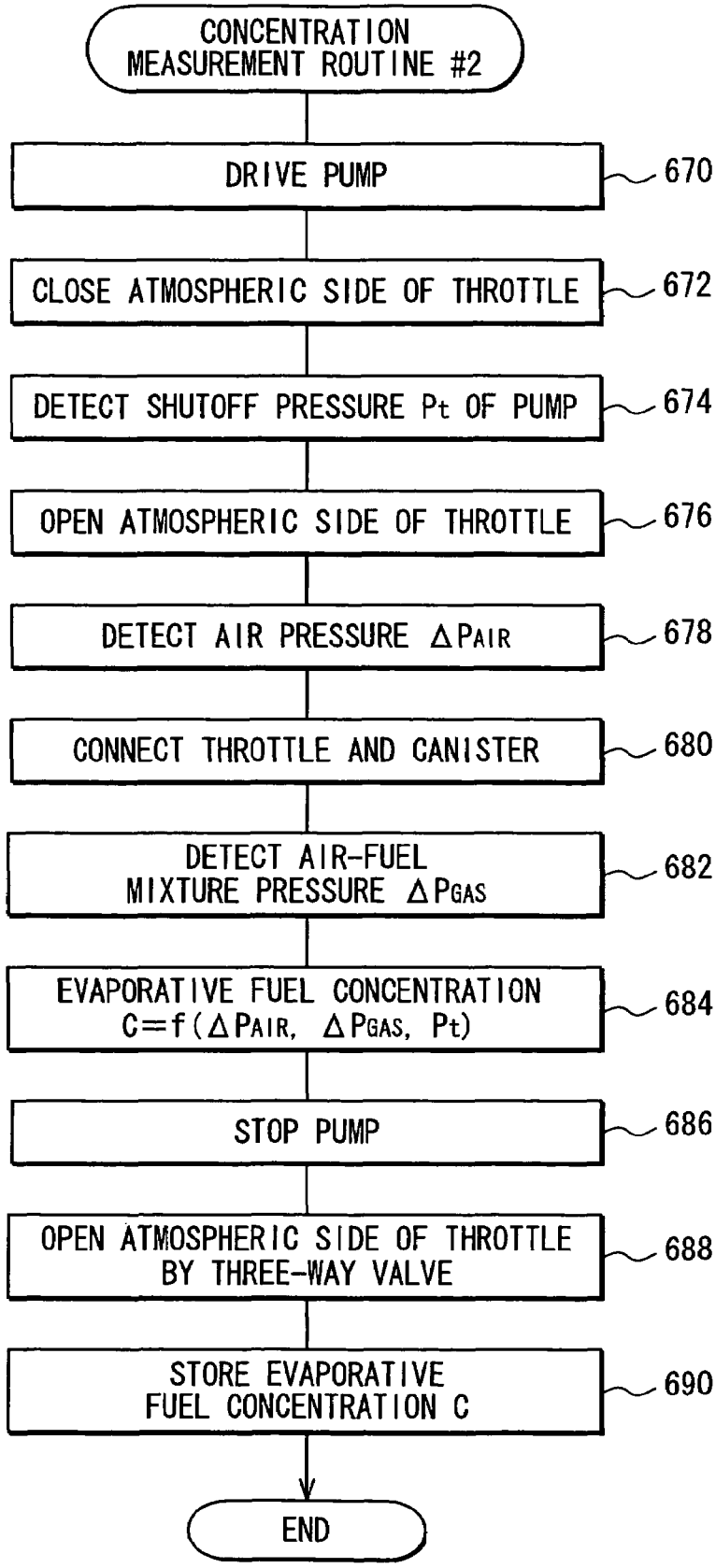
FIG. 25 is a flowchart illustrating a concentration measurement routine for the evaporative fuel treatment apparatus.

Concentration measurement routine #2 illustrated in FIG. 25 is a routine to measure the concentration of evaporative fuel in the canister 18 according to shutoff pressure Pt, air pressure $\Delta P_{AIR}$, and air-fuel mixture pressure $\Delta P_{GAS}$. Steps S670 to S678 and Steps S682 to S690 of concentration measurement routine #2 correspond to Steps S400 to S408 and Steps S412 to S420 of concentration measurement routine #1 illustrated in FIG. 7. Step S680 of concentration measurement routine #2 is different from Step S410 of concentration measurement routine #1 in that the ECU 20 controls the switching of the electromagnetic valves 32, 70 and thereby connects the throttle 30 and the canister 18.

Figure 26:
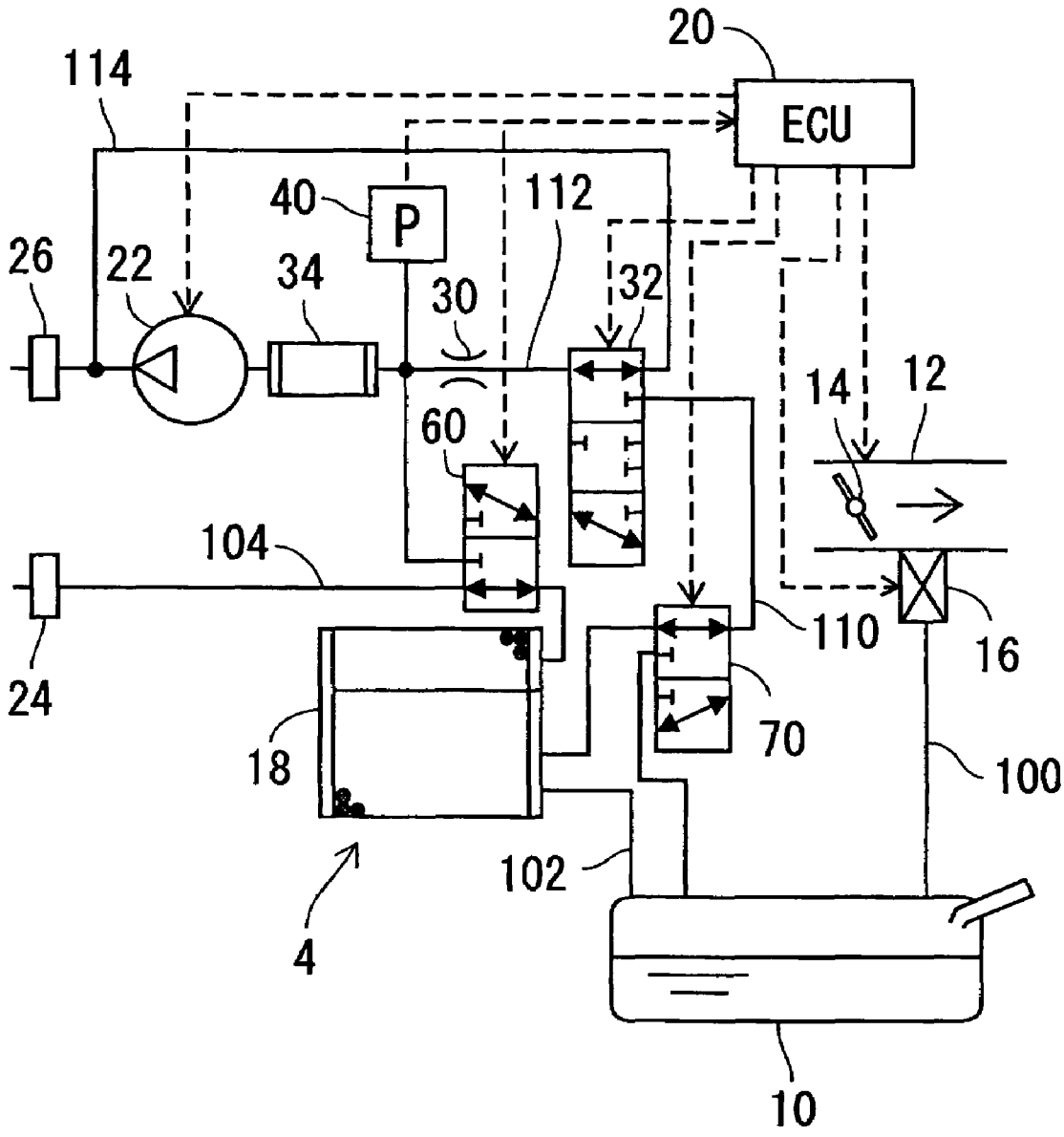
FIG. 26 is a schematic diagram illustrating another embodiment of the evaporative fuel treatment apparatus.

FIG. 26 illustrates another embodiment of the invention. Components that are similar to those of the above-described embodiments are marked with corresponding numerals. In this embodiment, the electromagnetic valve 60 is additionally installed between the measuring passage 112 between the throttle 30 and the second canister 34, and the canister 18 of the embodiment of FIG. 22. The electromagnetic valve 60 is installed for checking for leakage in the purge system constructed of the canister 18, passage 102, fuel tank 10, and purge passage 100, as in the embodiment of FIG. 20. Therefore, the throttle 30 is so set that its bore diameter is equivalent to the amount of leakage allowed for the purge system, and is also used as reference orifice for leakage check.

With respect to the multiple embodiments mentioned above, the property of fuel in the fuel tank 10 may be measured only when fuel is fed into the fuel tank 10, immediately after the internal combustion engine is started, or during normal operation immediately after the internal combustion engine is started.

In the multiple embodiments mentioned above, the concentration of evaporative fuel in the fuel tank 10 or the concentration of evaporative fuel in the canister 18 is measured by detecting shutoff pressure Pt, air pressure $\Delta P_{AIR}$, and air-fuel mixture pressure $\Delta P_{GAS}$. Instead, the evaporative fuel concentration may be measured with a concentration sensor installed at the fuel tank 10.

In the multiple embodiments mentioned above, the second canister 34 is installed in the measuring passage 112 between the pump 22 and the throttle 30, and the detection gain G for the differential value between air pressure $\Delta P_{AIR}$ and air-fuel mixture pressure $\Delta P_{GAS}$ is thereby increased. Instead, the invention may be so constructed that the second canister 34 is not installed.

In the multiple embodiments mentioned above, the pressure sensor 40 is connected to the measuring passage 112 between the throttle 30 and the second canister 34. Instead, it may be connected to the measuring passage 112 between the second canister 34 and the pump 22.

While only the selected preferred embodiments have been chosen to illustrate the present invention, it will be apparent to those skilled in the art from this disclosure that various changes and modifications can be made therein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. An evaporative fuel treatment apparatus comprising:

a fuel tank;

a purge passage that fluidly couples the intake path of an internal combustion engine and the fuel tank;

a purge valve that is installed in the purge passage and controls the quantity of evaporative fuel purged from the fuel tank into the intake path;

an evaporative fuel status measuring device that measures a density-based status of evaporative fuel in the fuel tank;

a purge valve controlling device that controls the purge valve based on the density-based status of the evaporative fuel measured by the evaporative fuel status measuring device; and a canister that absorbs evaporative fuel produced in the fuel tank;

wherein the evaporative fuel status measuring device comprises:

a measuring passage with a throttle provided therein;

a selector valve that is installed on one side of the measuring passage, and switches between communication between the throttle and the air, communication between the throttle and the fuel tank, and communication between the throttle and the canister;

a gas flow generating device that couples to the measuring passage on the side of the throttle opposite the selector valve, and generates a gas flow; and a pressure detecting device that detects a pressure caused by the throttle and the gas flow generating device.

2. The evaporative fuel treatment apparatus according to claim 1, wherein the evaporative fuel status measuring device measures the density-based status of the evaporative fuel based on:

a first pressure detected by the pressure detecting device when the gas flow generating device is in operation and the throttle and the air are coupled with each other; and a second pressure detected by the pressure detecting device when the gas flow generating device is in operation, the purge of evaporative fuel from the fuel tank into the intake path is stopped and the throttle and the fuel tank or the canister are coupled with each other.

3. An evaporative fuel treatment apparatus comprising:

a fuel tank;

a purge passage that fluidly couples the intake path of an internal combustion engine and the fuel tank;

a purge valve that is installed in the purge passage and controls the quantity of evaporative fuel purged from the fuel tank into the intake path;

an evaporative fuel status measuring device that measures a density-based status of evaporative fuel in the fuel tank;

a purge valve controlling device that controls the purge valve based on the density-based status of the evaporative fuel measured by the evaporative fuel status measuring device;

a temperature measuring device that measures the temperature in the fuel tank;

a pressure measuring device that measures the pressure in the fuel tank; and a fuel property measuring device that measures a property of fuel in the fuel tank based on:

the temperature in the fuel tank measured by the temperature measuring device;

the pressure in the fuel tank measured by the pressure measuring device; and the density-based status of evaporative fuel in the fuel tank measured by the evaporative fuel status measuring device.

4. The evaporative fuel treatment apparatus according to claim 3, further comprising an injection quantity controlling device that controls a fuel injection quantity of the internal combustion engine based on the property of fuel in the fuel tank measured by the fuel property measuring device.

5. The evaporative fuel treatment apparatus according to claim 3, further comprising:

an evaporative fuel status computing device that computes the density-based status of evaporative fuel in the fuel tank based on:

the temperature in the fuel tank measured by the temperature measuring device;

the pressure in the fuel tank measured by the pressure measuring device; and the property of fuel measured by the fuel property measuring device, and wherein the purge valve controlling device controls the purge valve based on the density-based status of evaporative fuel in the fuel tank acquired from at least one of the evaporative fuel status measuring device and the evaporative fuel status computing device.

6. The evaporative fuel treatment apparatus according to claim 3, wherein the fuel property measuring device measures the property of fuel when the fuel is fed into the fuel tank.

7. The evaporative fuel treatment apparatus according to claim 3, wherein the fuel property measuring device measures the property of fuel at an engine starting time of the internal combustion engine.

8. The evaporative fuel treatment apparatus according to claim 3, wherein the fuel property measuring device measures the property of fuel while the internal combustion engine is in operation.

* * * * *